US010560778B2

(12) United States Patent
Boyd

(10) Patent No.: US 10,560,778 B2
(45) Date of Patent: Feb. 11, 2020

(54) SYSTEM AND METHOD FOR A LOUDSPEAKER WITH A DIAPHRAGM

(71) Applicant: COLERIDGE DESIGN ASSOCIATES LLC, San Jose, CA (US)

(72) Inventor: Geoffrey Arthur Boyd, San Jose, CA (US)

(73) Assignee: COLERIDGE DESIGN ASSOCIATES LLC, San Jose, CA (US)

( * ) Notice: Subject to any disclaimer, the term of this patent is extended or adjusted under 35 U.S.C. 154(b) by 0 days.

(21) Appl. No.: 15/985,408

(22) Filed: May 21, 2018

(65) Prior Publication Data

US 2018/0270569 A1 Sep. 20, 2018

Related U.S. Application Data

(63) Continuation-in-part of application No. 15/280,983, filed on Sep. 29, 2016, now Pat. No. 9,980,050.

(60) Provisional application No. 62/234,410, filed on Sep. 29, 2015.

(51) Int. Cl.

| | |
|---|---|
| ***H04R 7/00*** | (2006.01) |
| ***H04R 1/28*** | (2006.01) |
| *H04R 7/04* | (2006.01) |
| *H04R 3/04* | (2006.01) |
| *H04R 9/02* | (2006.01) |

(52) U.S. Cl.

CPC ..... *H04R 1/2834* (2013.01); *H04R 1/2803* (2013.01); *H04R 3/04* (2013.01); *H04R 7/04* (2013.01); *H04R 9/025* (2013.01)

(58) Field of Classification Search

CPC . H04R 1/023; H04R 1/24; H04R 1/28; H04R 1/2803; H04R 1/2834; H04R 3/04; H04R 7/04; H04R 7/20; H04R 7/24; H04R 9/025; H04R 9/047; H04R 9/06; H04R 2207/021; H04R 7/16; H04R 9/04; H04R 23/02

USPC ..... 181/155; 340/426.43; 381/152, 186, 381/191, 398, 399, 400, 404, 409, 410, 381/430, 433, 92, 322, 394, 396, 408, 381/412, 414, 415, 423, 424, 431; 367/6

See application file for complete search history.

(56) References Cited

U.S. PATENT DOCUMENTS 3,436,494 A * 4/1969 Bozak ..... H04R 1/08 181/171
4,315,112 A * 2/1982 Hofer ..... H04R 7/122 181/165
4,531,025 A * 7/1985 Danley ..... H04R 9/045 381/117
5,583,944 A * 12/1996 Morohoshi ..... H04R 1/06 381/400

(Continued)

*Primary Examiner* — Gerald Gauthier

(74) *Attorney, Agent, or Firm* — Minisandram Law Firm; Raghunath S. Minisandram

(57) ABSTRACT

A loudspeaker is disclosed. The loudspeaker includes a diaphragm with a fixed portion and a movable portion. The fixed portion is attached to the movable portion by a plurality of leaf springs disposed between the fixed portion and the movable portion of the diaphragm. A coil is disposed over the diaphragm in the movable portion of the diaphragm. A magnet assembly is operatively disposed relative to the coil, wherein upon flow of current through the coil, the movable portion of the diaphragm moves relative to the fixed portion.

38 Claims, 15 Drawing Sheets

(56) References Cited

U.S. PATENT DOCUMENTS 5,627,903 A * 5/1997 Porrazzo ..... H04R 7/10 381/423
5,838,809 A * 11/1998 Sato ..... H04R 1/06 381/409
6,480,614 B1 * 11/2002 Denda ..... H04R 7/04 381/191
6,665,415 B1 * 12/2003 Heed ..... H04R 9/06 381/396
7,093,688 B2 * 8/2006 Lee ..... H04R 1/2803 181/155
7,433,486 B2 * 10/2008 Kaiwa ..... H04R 1/06 379/433.1
7,929,726 B1 * 4/2011 Jones ..... H04R 9/047 381/343
2002/0021821 A1 * 2/2002 Tanase ..... H04R 9/025 381/431
2002/0114214 A1 * 8/2002 Hansen ..... H04R 7/12 367/6
2003/0048920 A1 * 3/2003 Van Halteren ..... H04R 9/063 381/424
2003/0194106 A1 * 10/2003 Tsuda ..... H04R 31/006 381/412
2003/0194107 A1 * 10/2003 Tsuda ..... H04R 31/006 381/415
2004/0136558 A1 * 7/2004 Usuki ..... H04R 9/025 381/394
2004/0151334 A1 * 8/2004 Vaudrey ..... H04R 11/02 381/322
2005/0031153 A1 * 2/2005 Nguyen ..... H04R 9/025 381/414
2005/0036647 A1 * 2/2005 Nguyen ..... H04R 7/045 381/423
2005/0220320 A1 * 10/2005 Kim ..... H04R 9/025 381/396
2006/0177090 A1 * 8/2006 Regl ..... H04R 9/025 381/408
2006/0290481 A1 * 12/2006 Kitazawa ..... H04R 3/002 340/426.34
2008/0019558 A1 * 1/2008 Simidian, II ..... H04R 9/047 381/408
2008/0063235 A1 * 3/2008 Takewa ..... H04R 7/04 381/412
2008/0219469 A1 * 9/2008 Simidian ..... H04R 9/047 381/92
2009/0226028 A1 * 9/2009 Suganuma ..... H04R 7/06 381/430
2010/0278371 A1 * 11/2010 Hanada ..... H04R 7/10 381/398
2011/0274309 A1 * 11/2011 Doh ..... H04R 9/047 381/398
2011/0293121 A1 * 12/2011 Yan ..... H04R 7/04 381/191
2012/0308070 A1 * 12/2012 Lee ..... H04R 9/025 381/412
2013/0016874 A1 * 1/2013 Huang ..... H04R 9/043 381/433
2013/0156253 A1 * 6/2013 Lemarquand ..... B81B 3/007 381/396
2014/0056464 A1 * 2/2014 Li ..... H04R 9/025 381/400
2014/0270269 A1 * 9/2014 Hsieh ..... H04R 9/022 381/152
2015/0110334 A1 * 4/2015 Colich ..... H04R 7/06 381/396
2015/0264486 A1 * 9/2015 Yuan ..... H04R 7/04 381/431
2015/0350791 A1 * 12/2015 Yang ..... H04R 9/046 381/399
2016/0021460 A1 * 1/2016 Shi ..... H04R 9/025 381/398
2016/0212546 A1 * 7/2016 Salvatti ..... H04R 9/06
2016/0373862 A1 * 12/2016 Yoon ..... H04R 9/06
2017/0085979 A1 * 3/2017 Noro ..... H04R 1/24
2017/0134861 A1 * 5/2017 Epping ..... H04R 9/025
2017/0280247 A1 * 9/2017 Kobayashi ..... H04R 7/12
2017/0353783 A1 * 12/2017 Hou ..... H04R 9/02
2018/0014126 A1 * 1/2018 Boyd ..... H04R 7/24
2018/0041844 A1 * 2/2018 Shan ..... H04R 23/02
2018/0077495 A1 * 3/2018 Liu ..... H04R 7/16
2018/0270569 A1 * 9/2018 Boyd ..... H04R 1/2834

* cited by examiner

SYSTEM AND METHOD FOR A LOUDSPEAKER WITH A DIAPHRAGM

RELATED APPLICATION

This application is a continuation-in-part application of and claims priority to U.S. patent application Ser. No. 15/280,983 filed on Sep. 29, 2016, entitled "System And Method For A Loudspeaker With A Diaphragm" which claims priority to U.S. provisional patent application No. 62/234,410 filed on Sep. 29, 2015, entitled "Flat Panel Diaphragm Loudspeaker". Patent application Ser. No. 15/280,983 is incorporated herein by reference, in its entirety. Patent application No. 62/234,410 is incorporated herein by reference, in its entirety.

TECHNICAL FIELD

The present invention relates generally to electromechanical acoustic devices and more specifically, to loudspeaker drivers.

DESCRIPTION OF RELATED ART

Various diaphragm loudspeakers have been disclosed previously. As an example, a balanced modal radiator (BMR) loudspeaker is disclosed in U.S. Pat. No. 7,916,878. However, some of these loudspeakers do not exhibit a satisfactory sound pressure level power sensitivity, sometimes called power efficiency, which is the sound pressure level in decibels measured at 1 meter distance for an input power of 1 Watt.

It may be beneficial to provide a loudspeaker with satisfactory sound pressure level sensitivity, among other things desirable in a loudspeaker.

With these needs in mind, the current disclosure arises. This brief summary has been provided so that the nature of the disclosure may be understood quickly. A more complete understanding of the disclosure can be obtained by reference to the following detailed description of the various embodiments thereof in connection with the attached drawings.

SUMMARY OF THE INVENTION

In one embodiment a loudspeaker is disclosed. The loudspeaker includes a diaphragm with a fixed portion and a movable portion. The fixed portion is attached to the movable portion by a plurality of leaf springs disposed between the fixed portion and the movable portion of the diaphragm. A coil is disposed over the diaphragm in the movable portion of the diaphragm. A magnet assembly is operatively disposed relative to the coil, wherein upon flow of current through the coil, the movable portion of the diaphragm moves relative to the fixed portion.

This brief summary is provided so that the nature of the disclosure may be understood quickly. A more complete understanding of the disclosure can be obtained by reference to the following detailed description of the preferred embodiments thereof in connection with the attached drawings.

BRIEF DESCRIPTION OF THE DRAWINGS

The foregoing and other features of several embodiments are described with reference to the drawings. In the drawings, the same components have the same reference numerals. The illustrated embodiments are intended to illustrate but not limit the invention. The drawings include the following figures.

DETAILED DESCRIPTION

To facilitate an understanding of the adaptive aspects of the present disclosure, an example loudspeaker will be described. The specific construction and operation of the adaptive aspects of various elements of the example loudspeaker are described with reference to the example loudspeaker.

Figure 1:
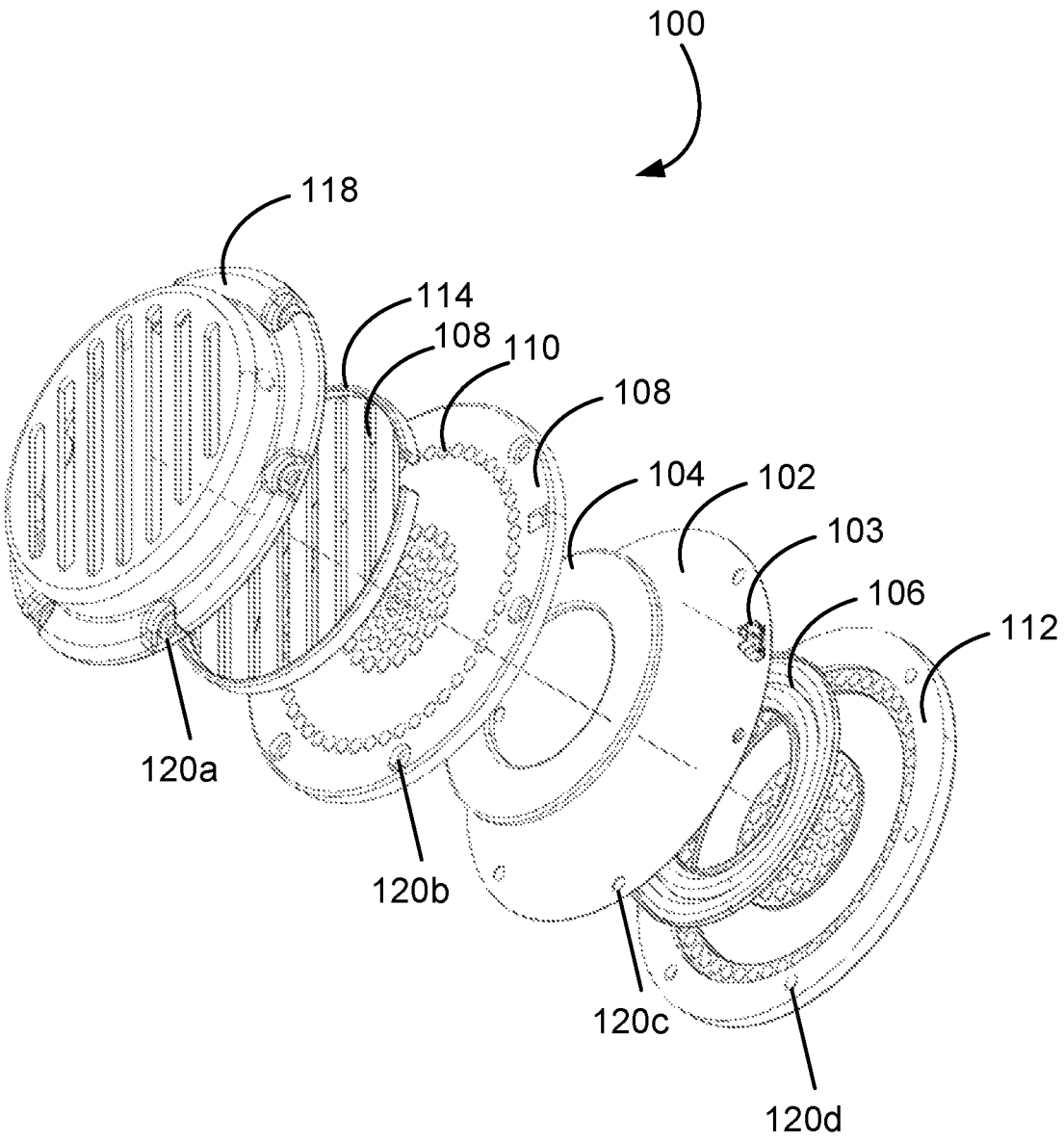
FIG. 1 shows an example loudspeaker, according to one aspect of the present disclosure.

FIG. 1 shows an exploded view of an example loudspeaker 100. The loudspeaker 100 includes a diaphragm 102, a top magnet assembly 104 and a bottom magnet assembly 106 operatively disposed relative to the diaphragm 102. The diaphragm 102 includes a connector block 103. Functions and features of the diaphragm 102 will be later described in detail with reference to FIGS. 2 and 2A. Functions and features of the top magnet assembly 104 and the bottom magnet assembly 106 will also be later described in detail with reference to FIGS. 3, 3A, 3B and 3C. A top receiver cover 108 with a plurality of holes 110 is disposed over the top magnet assembly 102. In one example, the plurality of holes 110 are disposed surrounding the top magnet assembly 104. The top magnet assembly 104 is attached to the top receiver cover 108.

A bottom receiver cover 112 with a plurality of holes 110 is disposed over the bottom magnet assembly 106. In one example, the plurality of holes 110 are disposed surrounding the bottom magnet assembly 106. The bottom magnet assembly 106 is attached to the bottom receiver cover 112. A grill plate 114 with a plurality of grills 116 is disposed between the top receiver cover 108 and a top cover 118.

A plurality of fasteners (not shown) may be used to fasten together the top cover 118, top receiver cover 108, diaphragm 102 and the bottom receiver cover 112. For example, a fastener (not shown) may be passed through a plurality of aligned holes 120*a*-120*d* disposed in the top cover 118, top receiver cover 108, diaphragm 102 and the bottom receiver cover 112 respectively. In some examples, a cushion ring may be disposed over the exterior of the bottom receiver cover, when the loudspeaker is used as a head phone, to provide a soft surface to rest over an ear.

Figure 2:
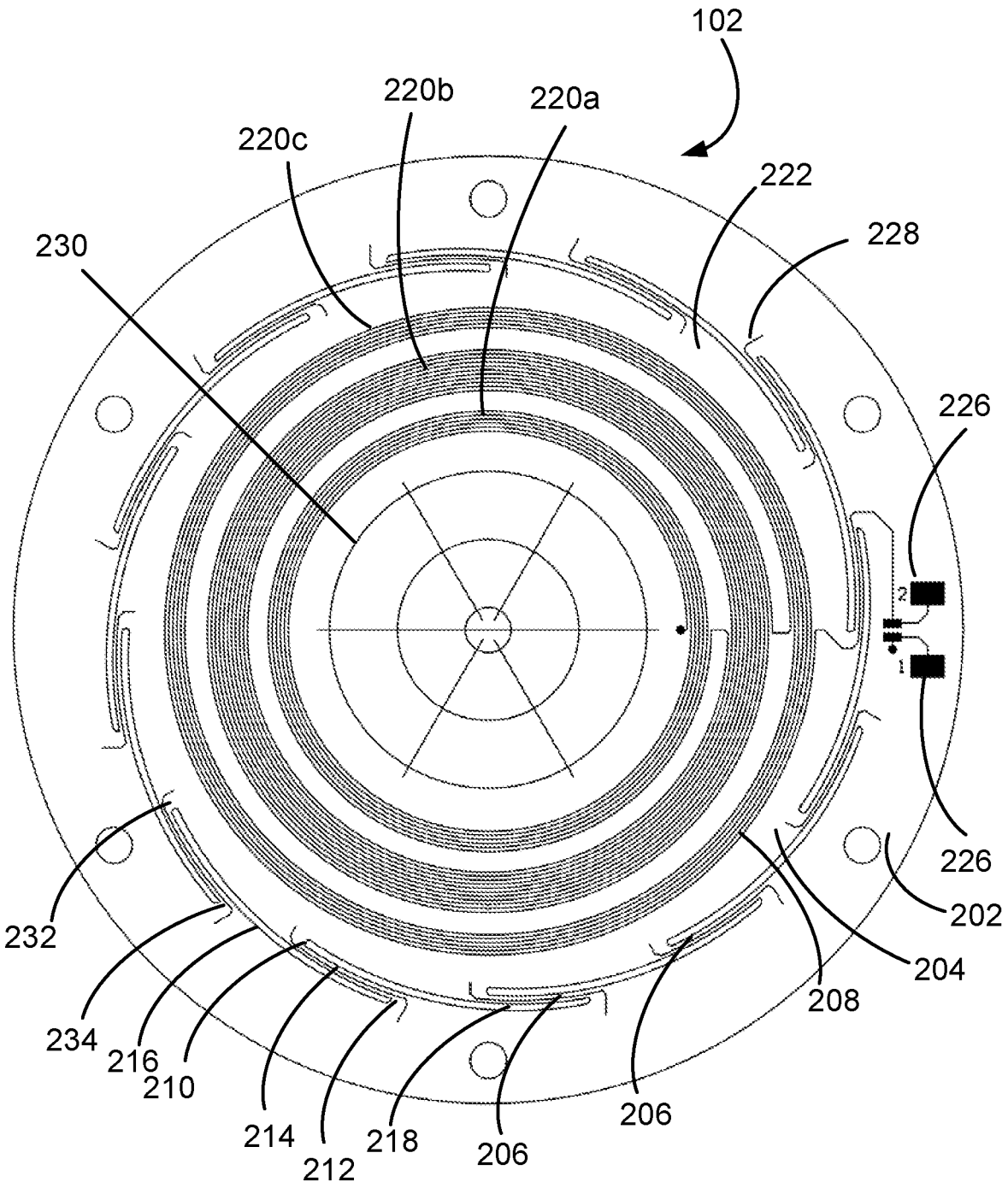
FIG. 2 shows top view of an example diaphragm of the loudspeaker of FIG. 1, according an aspect of the present disclosure.

Now, referring to FIG. 2, a top view of an example diaphragm 102 is shown. In one example, the diaphragm 102 is a planar substrate. The diaphragm 102 has a fixed portion 202 and a movable portion 204. The fixed portion 202 is attached to the movable portion 204 by a plurality of leaf springs 206. The plurality of leaf springs 206 extend from an outer periphery 232 of the movable portion 204 to the inner periphery 234 of the fixed portion 202. A coil 208 is disposed over the movable portion 204 of the diaphragm 102.

The leaf spring 206 includes a first end portion 210, a second end portion 212 and a body portion 214. The first end portion 210 is connected to the movable portion 204 of the diaphragm 102. The first end portion 210 is connected to the movable portion 204 about the outer periphery 232 of the movable portion 204. The second end portion 212 is connected to the fixed portion 202 of the diaphragm 102. The second end portion 212 is connected to the fixed portion 202 about the inner periphery 234 of the fixed portion 202. A gap between the body portion 214 of the leaf spring 206 and the movable portion 204 of the diaphragm 102 define a portion of a first slot 216. A gap between the body portion 214 of the leaf spring 206 and the fixed portion 202 of the diaphragm 102 define a portion of a second slot 218. The first slot 216 extends to an adjacent leaf spring 206 to define a gap between the body portion of the adjacent leaf spring and the movable portion 204 of the diaphragm 102. The second slot 218 extends to another adjacent leaf spring to define a gap between the body portion of the another adjacent leaf spring and the fixed portion 202 of the diaphragm 102.

In one example, the first slot 216 and the second slot 218 are filled with a material to substantially maintain a pressure differential between a top portion of the diaphragm 102 and a bottom portion of the diaphragm 102. In one example, the pressure differential is created by the movement of the movable portion of the diaphragm 102, for example, upon flow of a current in the coil 208.

In one example, the dimension and material properties of the leaf spring 206 between the first end portion 210 and the second end portion 212 define various characteristics of the leaf spring 206. For example, the spring stiffness or spring compliance may be selectively chosen to optimize frequency response of the loudspeaker, within a certain range of frequencies.

Figure 2A:
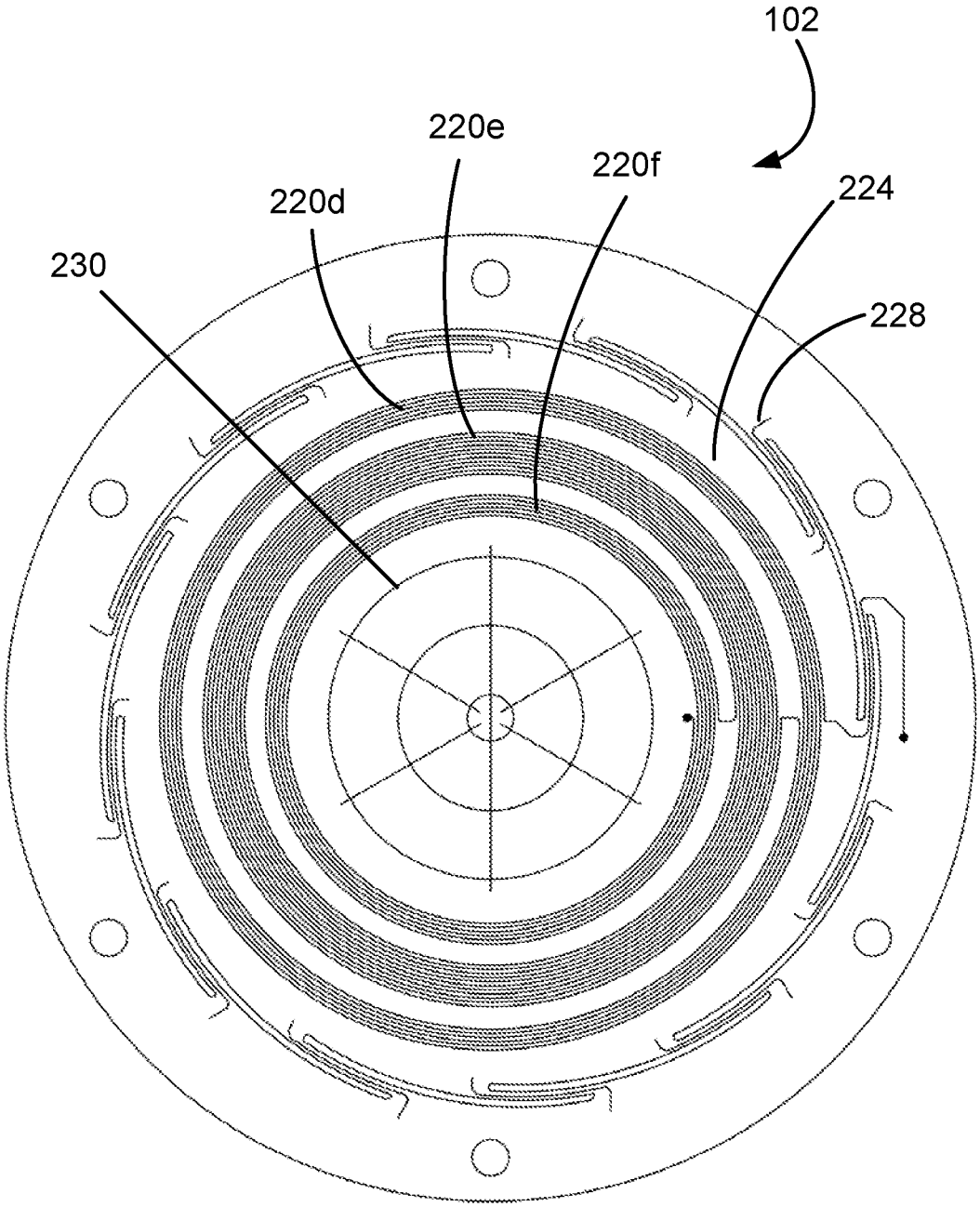
FIG. 2A shows bottom view of the example diaphragm of the loudspeaker of FIG. 1, according to an aspect of the present disclosure.

Now, referring to FIG. 2A, a bottom view of the diaphragm 102 is shown. Now, referring to both FIGS. 2 and 2A, various functions and features of the coil 208 will now be described. The coil 208 includes a plurality of sub coils 220. In one example, the coil 208 includes a plurality of sub coils 220 disposed both on the top portion 222 of the diaphragm 102 and the bottom portion 224 of the diaphragm 102. For example, sub coils 220*a*, 220*b* and 220*c* (shown in FIG. 2) are disposed on the top portion of the diaphragm 102. And, sub coils 220*d*, 220*e* and 220*f* (shown in FIG. 2A) are disposed on the bottom portion 224 of the diaphragm 102. A plurality of connector pads 226 are disposed on the top portion 222 of the diaphragm 102.

In this example, the plurality of sub coils 220*a*-220*f* are connected in series. Ends of the coil 208 are connected to one of the connector pads 226. Terminals of the connector block 102 (as shown in FIG. 1) is coupled to the plurality of connector pads 226, to electrically couple the connectors of the connector block 102 to the coil 208. For example, a portion of the conductor of the coil 208 enters and exits the movable portion 204 of the diaphragm 102 over the body portion 214 of one of the leaf spring 206. A plurality of dummy conductors 228 are disposed in the body portion of the other leaf springs 206 so as to maintain a substantially similar compliance between the one of the leaf springs over which portion of the conductor of the coil 208 enters and exits and other leaf springs.

In one example, the sub coils 220 disposed on the top portion 222 are each substantially physically aligned with a corresponding sub coils 220 disposed on the bottom portion 224 of the diaphragm 102, to form a sub coil pair. For example, the sub coil 220*a* is physically aligned with sub coil 220*f* to form a sub coil pair 220*a*-220*f*. Similarly, the sub coil 220*b* is physically aligned with sub coil 220*e* to form another sub coil pair 220*b*-200*e*. And, the sub coil 220*c* is physically aligned with sub coil 220*d* to form yet another sub coil pair 220*c*-220*d*.

In one example, the direction of winding of the conductors of the sub coil pairs are such that a current flowing in the sub coil pair will flow in the same direction. For example, the direction of the current flowing through the sub coil pair 220*a*-200*f* will be the same. Similarly, the direction of the current flowing through the sub coil pair 220*b*-200*e* will be the same. And, the direction of the current flowing through the sub coil pair 220*c*-200*d* will be the same.

In one example, the length of the sub coil conductors are selectively chosen to generate a substantially uniform force across the sub coils. For example, the length of the conductors in each of the sub coil pairs may be different so as to generate a substantially uniform force across the sub coils.

In one example, a copper clad flexible printed circuit may be used to fabricate the coil. For example, by selectively etching the copper layer on the flexible printed circuit, various sub coils of disclosure may be fabricated. In one example, selectively etched copper clad flexible printed circuit may be used as a combination of the diaphragm and the coils.

In some examples, a stiffener 230 may be selectively disposed in an inner portion of the movable portion 204 so as to maintain a substantially constant mechanical impedance for the movable portion 204 of the diaphragm 102.

In one example, a copper clad flexible printed circuit may be used to fabricate the coil. For example, by selectively etching the copper layer on the flexible printed circuit, various sub coils of disclosure may be fabricated. Additionally, the stiffener may also be formed by selectively etching the copper layer on the flexible printed circuit. Additionally, dummy conductors may also be formed by selectively etching the copper layer on the flexible printed circuit. In one example, selectively etched copper clad flexible printed circuit may be used as a combination of the diaphragm and the coils. Further, the flexible printed circuit may be selectively laser cut to form the first slot and the second slot of the plurality of leaf springs.

In another example, conductive ink may be selectively printed on a substrate to form the coil on the substrate. In one example, the substrate along with the selectively printed coil copper clad flexible printed circuit may be used as a combination of the diaphragm and the coils. Further, the substrate may be selectively laser cut to form the first slot and the second slot of the plurality of leaf springs.

In yet another example, Electroless Nickel Immersion Gold (ENIG) may be selectively deposited on a substrate to form a profile of the coil on the substrate, which acts as a seed layer. Over the ENIG seed layer, the coil may be electroplated in aqueous electrolyte with copper to get a coil of required thickness. In this example, selectively deposited coil along with the substrate may be used as a combination of the diaphragm and the coils. Further, the substrate may be selectively laser cut to form the first slot and the second slot of the plurality of leaf springs.

Figure 3:
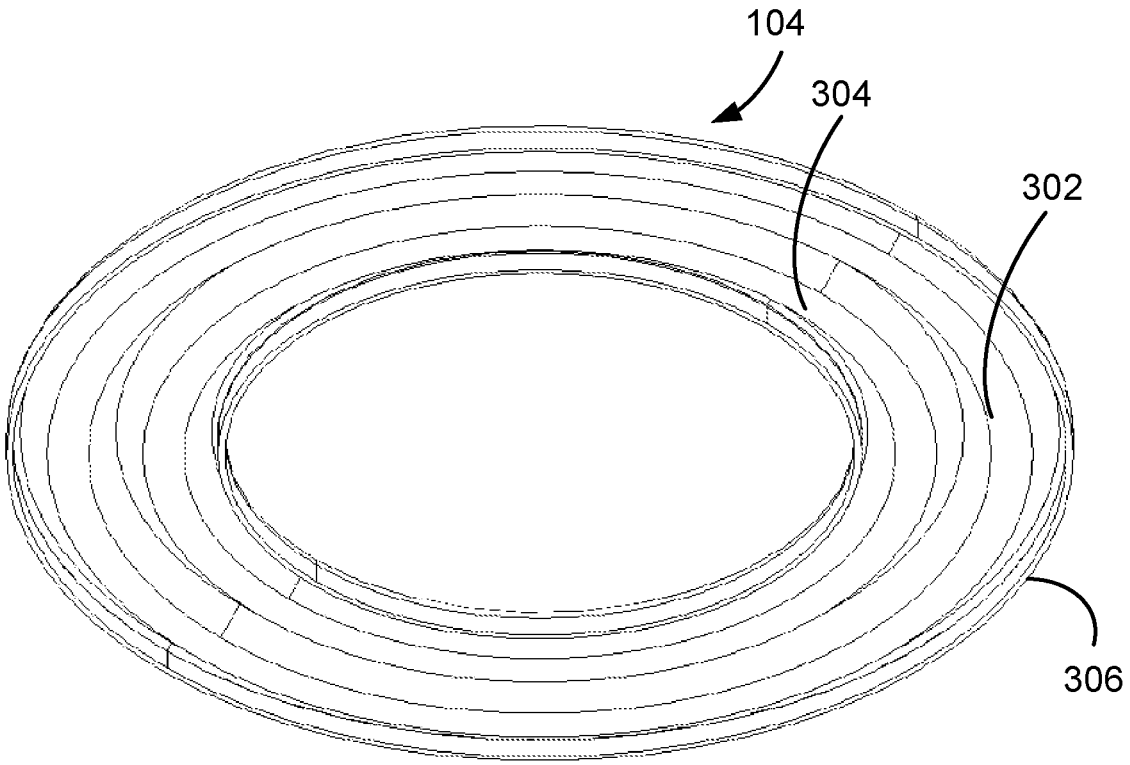
FIG. 3 shows bottom view of the top magnet assembly, according to an aspect of the present disclosure.

Now, referring to FIGS. 3, 3A, 3B and 3C, various functions and features of the top magnet assembly 104 and bottom magnet assembly 106 will now be described. Referring to FIG. 3, a bottom view of the top magnet assembly 104 is shown. The top magnet assembly 104 includes an outer ring magnet 302 and an inner ring magnet 304. The outer ring magnet 302 and inner ring magnet 304 are spaced apart and held in a holder 306. The outer ring magnet 302 and inner ring magnet 304 may be compression bonded Neodymium ring magnets of substantially same width, with isosceles trapezoid cross-section at about 45 degrees.

Figure 3A:
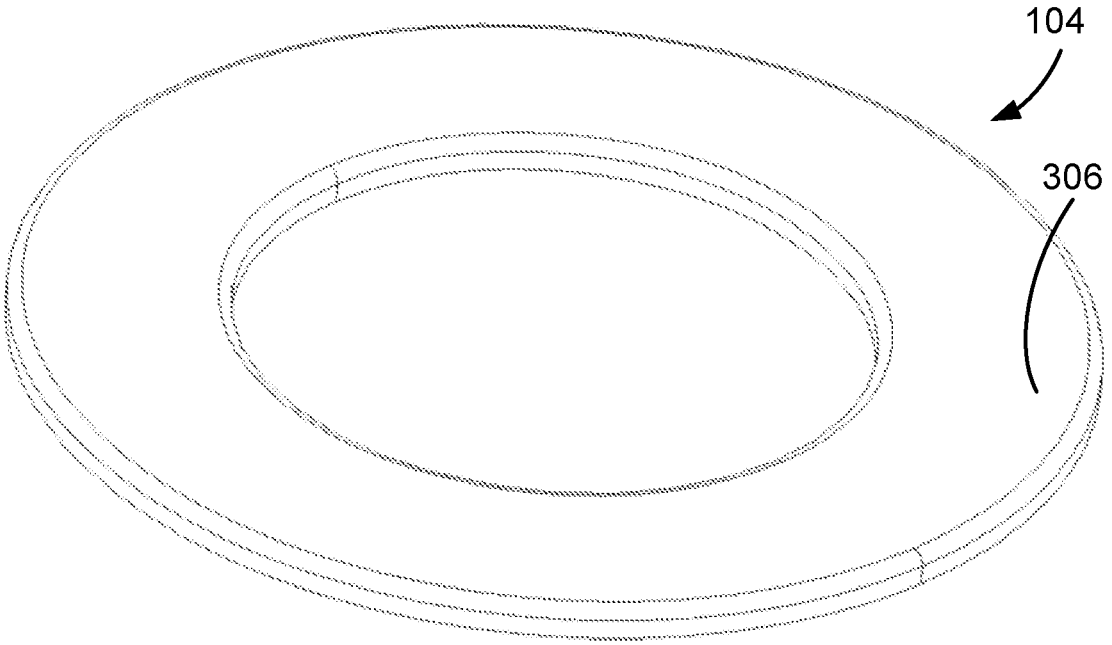
FIG. 3A shows top view of the top magnet assembly, according to an aspect of the present disclosure.

Now, referring to FIG. 3A, a top view of the top magnet assembly 104 is shown. For example, the holder 306 is shown in the top view of the top magnet assembly 104. The holder 306 may be made of a soft steel material.

Figure 3B:
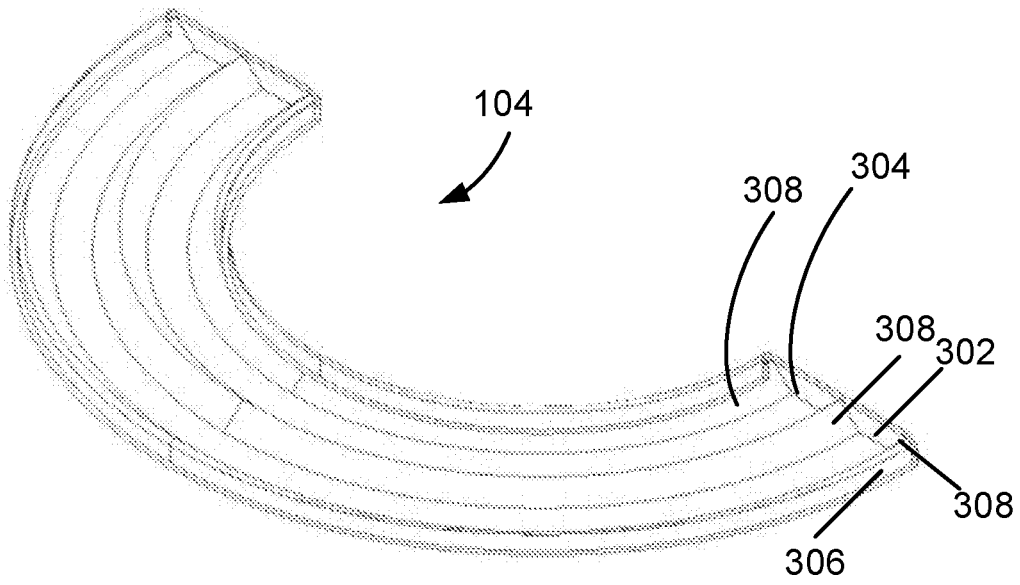
FIG. 3B shows a cross-section of a portion of the top magnet assembly, according to an aspect of the present disclosure.

Now, referring to FIG. 3B, a cross-section of a portion of the top magnet assembly 104 is shown, with the holder 306, outer ring magnet 302 and inner ring magnet 304, with side surface 308 of the outer ring magnet 302 and inner ring magnet 304 that form the inclined surfaces of the trapezoidal cross-section.

Figure 3C:
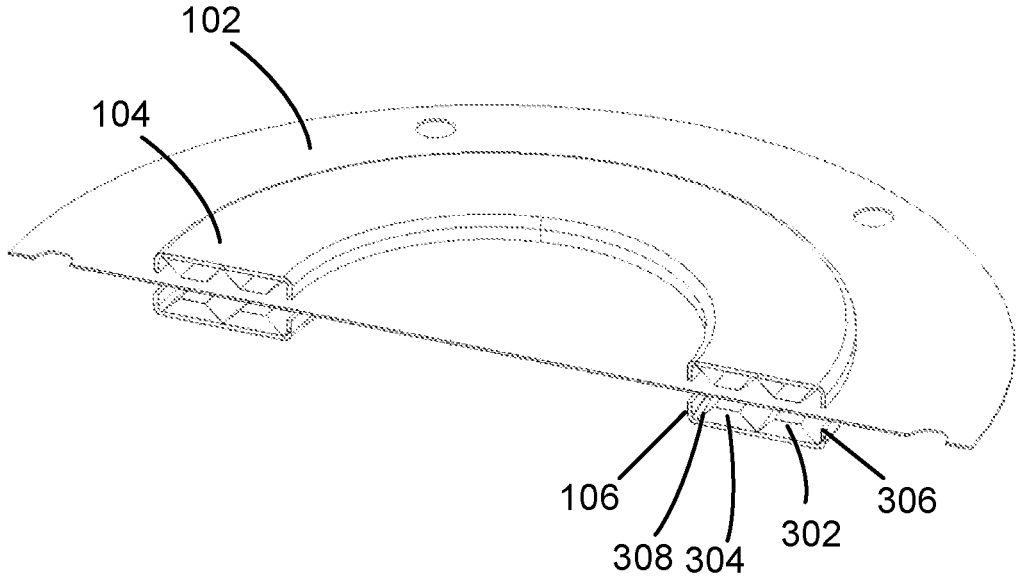
FIG. 3C shows a partial cross-section of the top magnet assembly and the bottom magnet assembly, according to an aspect of the present disclosure.

Now, referring to FIG. 3C, a partial cross-sectional view of the top magnet assembly 104 and the bottom magnet assembly 106 operatively disposed with reference to the diaphragm 102 is shown. As one skilled in the art appreciates, the bottom magnet assembly 106 is constructed similar to the top magnet assembly 104, as previously described with reference to FIGS. 3, 3A and 3B. For example, the bottom magnet assembly 106 includes a holder 306, outer ring magnet 302 and inner ring magnet 304, with side surface 308 of the outer ring magnet 302 and inner ring magnet 304 that form the inclined surfaces of the trapezoidal cross-section.

Figure 3D:
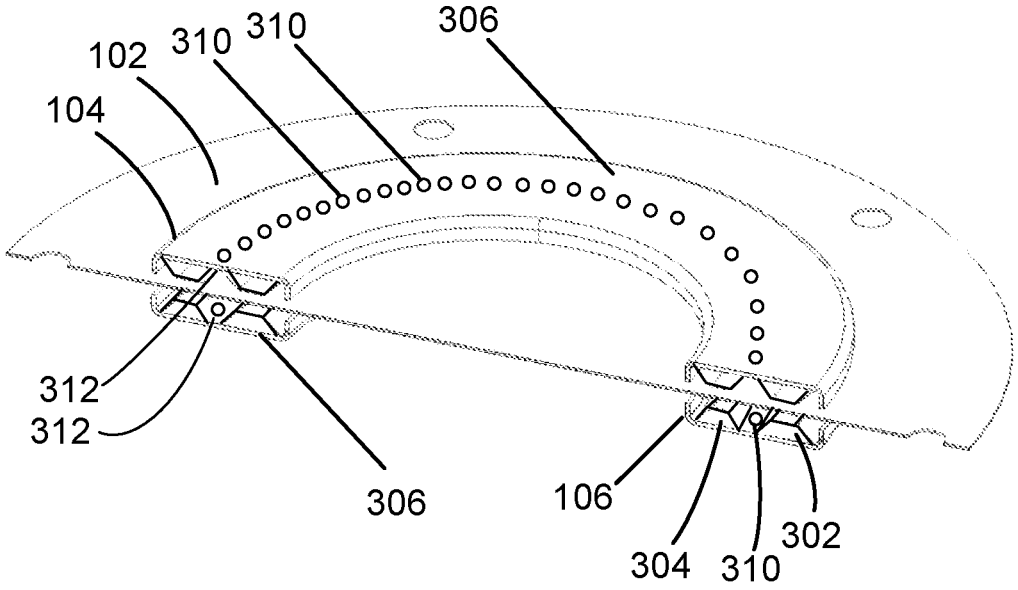
FIG. 3D shows a partial cross-section of the top magnet assembly and the bottom magnet assembly, with perforations in the holder, according to an aspect of the present disclosure.

Now, referring to FIG. 3D, a partial cross-sectional view of the top magnet assembly 104 and the bottom magnet assembly 106 operatively disposed with reference to the diaphragm 102 is shown. In this example, the holder 306 of the top magnet assembly 104 and the bottom magnet assembly have a plurality of through holes 310 disposed over the holder 306. The through holes 310 permit sound produced due to the vibration of the diaphragm 102 to pass through the top magnet assembly 104 and the bottom magnet assembly 106. In one example, by permitting the sound to pass through the top magnet assembly 104 and the bottom magnet assembly 106 improves the performance of the loudspeaker at higher frequencies, for example, frequencies above 10 KHz.

In one example, the outer ring magnet 302 and the inner ring magnet 304 are spaced apart in the holder 306 such that there is a gap 312 between the outer ring magnet 302 and the inner ring magnet 304. In one example, the through holes 310 are disposed in the gap 312 between the outer ring magnet 302 and the inner ring magnet 304.

Figure 4A:
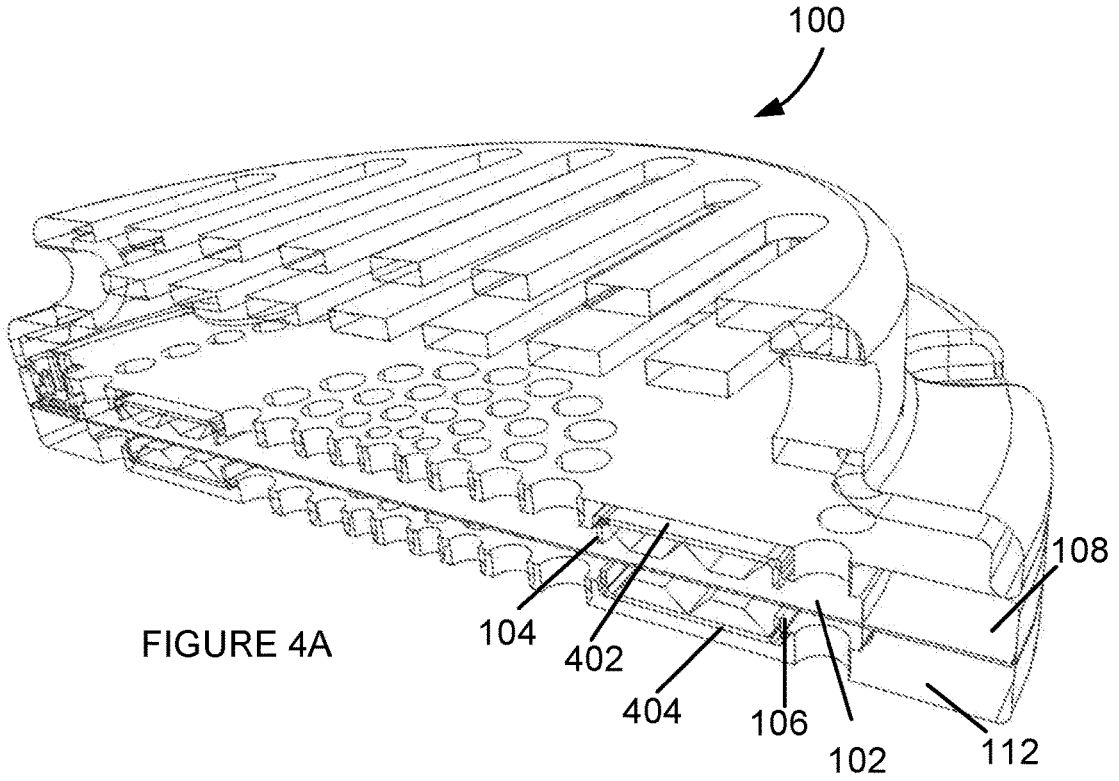
FIG. 4A shows another partial cross-sectional view of the loudspeaker of FIG. 1, according to an aspect of the present disclosure.

FIG. 4A shows yet another partial cross-sectional view of the loudspeaker 100 as previously described with reference to FIG. 1. The top magnet assembly 102 is disposed in a recess 402 of the top receiver cover 108. The bottom magnet assembly 104 is disposed in a recess 404 of the bottom receiver cover 108. In one example, the top magnet assembly 102 is glued to the top receiver cover 108. In one example, the bottom magnet assembly 104 is glued to the bottom receiver cover 112. The diaphragm 102 is disposed between the top magnet assembly 104 and the bottom magnet assembly 106 so as to operatively dispose the sub coils relative to the top magnet assembly 104 and the bottom magnet assembly 106. This will be further described with reference to FIG. 4B.

Figure 4B:
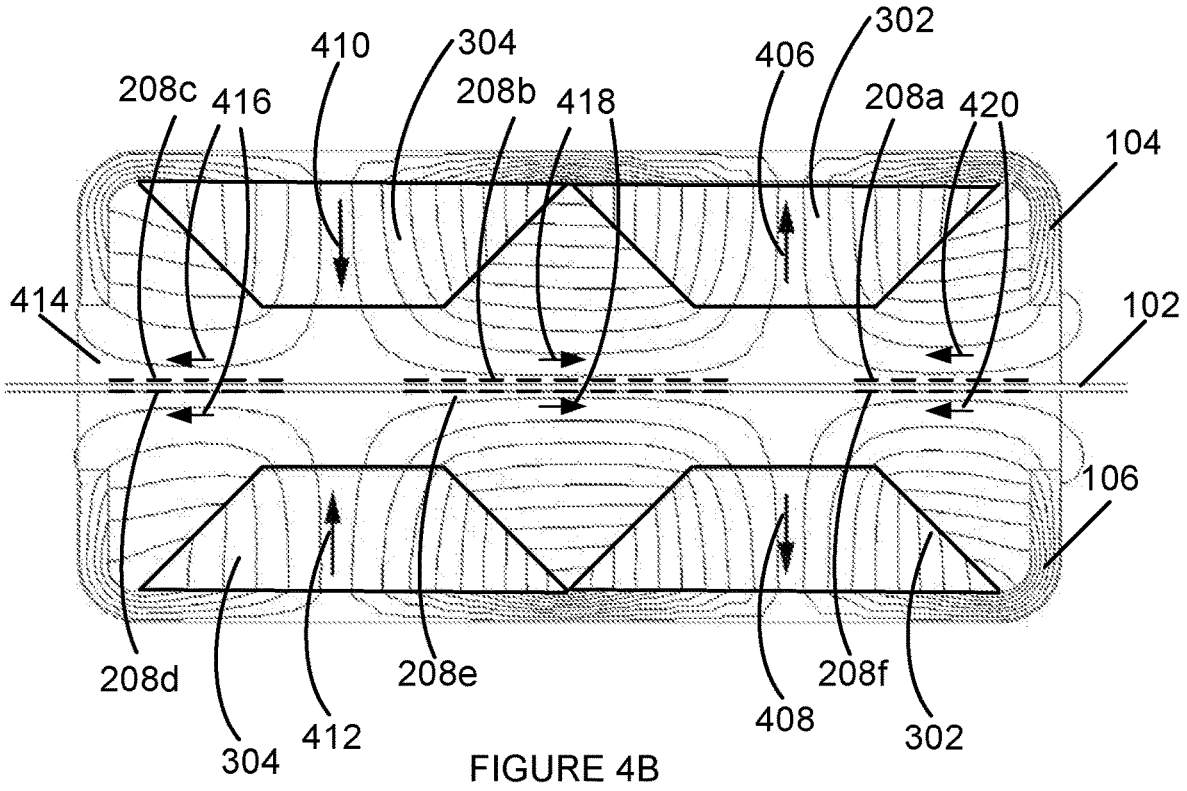
FIG. 4B shows another partial cross-sectional view of the loudspeaker of FIG. 1, showing magnetic field generated by the top magnet assembly and the bottom magnet assembly, according to an aspect of the present disclosure.

Now, referring to FIG. 4B, another partial cross-sectional view of the loudspeaker 100 is shown, to describe the electro-magnetic interaction between the top magnet assembly 104, bottom magnet assembly 106 and the sub coil pairs of the coil 208 disposed on the diaphragm 102. In this example, the outer ring magnet 302 of the top magnet assembly 104 and the outer ring magnet 302 of the bottom magnet assembly 106 are magnetized so as to oppose each other, as shown by arrows 406 and 408. And, the inner ring magnet 304 of the top magnet assembly 104 and the inner ring magnet 304 of the bottom magnet assembly 106 are magnetized so as to attract each other, as shown by arrows 410 and 412. The gap between the top magnet assembly 104 and the bottom magnet assembly 106 defines an air gap 414. The sub coil pairs of the coil 208 is disposed in the air gap 414 and subjected to the magnetic field generated by the outer ring magnets 302 and inner ring magnets 304 of the top magnet assembly 104 and the bottom magnet assembly 106.

The direction of the magnetic flux fields generated by the outer ring magnets 302 and the inner ring magnets 304 in the air gap 414 are shown by arrows 416, 418 and 420. In other words, the top magnet assembly 104 and the bottom magnet assembly 106 create a magnetic field substantially in the plane of the diaphragm 102 and perpendicular to the flow of current through the sub coil pairs of the coil 208. More specifically, the sub coil pairs 208*c*-208*d* are subjected to magnetic field in a direction shown by arrow 416. The sub coil pairs 208*b*-208*e* are subjected to magnetic field in a direction shown by arrow 418. And, the sub coil pairs 208*a*-208*f* are subjected to magnetic field in a direction shown by arrow 420.

Figure 4C:
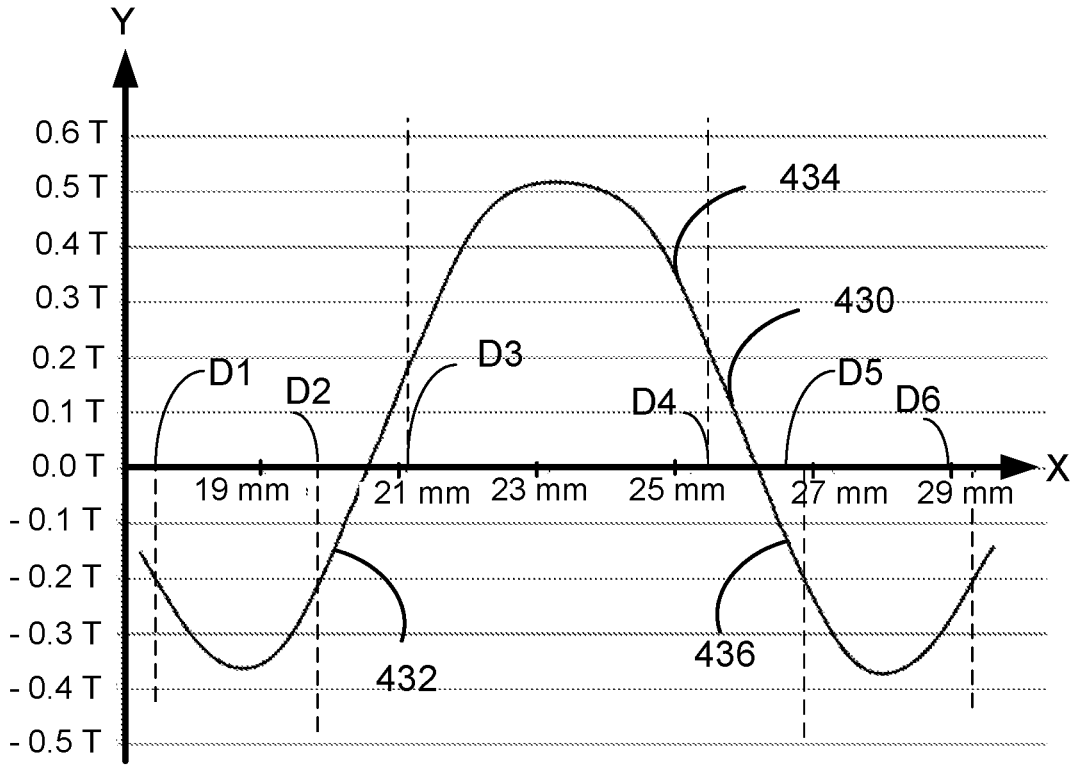
FIG. 4C shows a graph showing magnetic field strength generated by the top magnet assembly and the bottom magnet assembly, according to an aspect of the present disclosure.

Now, referring to FIG. 4C, an example selective placement of the sub coils relative to the center of the diaphragm 102 based on the magnetic field strength will now be described. Referring to FIG. 4C, graph 430 shows an example magnetic field strength generated by the top magnet assembly and the bottom magnet assembly, from a center of the diaphragm. For example, the X axis shows the distance from the center of the diaphragm and Y axis shows the magnetic field strength at various locations of the diaphragm, along a radius.

For example, the portion 432 of the graph 430 (below the X axis) shows the magnetic field strength imparted in the vicinity of the sub coil pairs 208*c*-208*d*. The portion 434 of the graph 430 (above the X axis) shows the magnetic field strength imparted in the vicinity of sub coils 208*b*-208*e*. And the portion 436 of the graph 430 (below the X axis) shows the magnetic field strength imparted in the vicinity of the sub coils 208*a*-208*f*.

In one example, the sub coils are selectively placed on the diaphragm, so that the magnetic field strength imparted on the sub coil is above a threshold value. For example, if the threshold value for the magnetic field strength is chosen to be above + or − 0.2 Tesla, the sub coils 208*c*-208*d* are placed between a distance of D1 and D2 from the center of the diaphragm. The sub coils 208*b*-208*e* are placed between a distance of D3 and D4 from the center of the diaphragm. And, the sub coils 208*a*-208*f* are placed between a distance of D5 and D6.

As one skilled in the art appreciates, when a current flows through the sub coil pairs of the coil 208, the amount of force generated due to the interaction of the current flowing through the sub coils is dependent on the length of the sub coil and the magnetic field strength the sub coil is subjected to. In this example, the sub coil pairs 208*b*-208*e* are subjected to a higher magnetic field strength than the sub coil pairs 208*c*-208*e* and 208*a*-208*f*. In one example, the sub coil winding length is selectively chosen to generate a substantially uniform force across all the sub coils.

In one example, the direction of current flowing through the sub coil pairs are chosen such that the movable portion of the diaphragm 102 is moved in the same direction. In this example, the sub coil pair 208*b*-208*e* is subjected to a magnetic field in the direction as shown by arrow 418. However, the sub coil pairs 208*a*-208*f* and 208*c*-208*f* are subjected to a magnetic field in the direction as shown by arrow 416 and 420, which are opposite to the direction as shown by arrow 418. In order to move the movable portion of the diaphragm 102 in the same direction, the direction of flow of current in sub coil pair 208*b*-208*e* will be opposite to the direction of flow of current in sub coil pairs 208*a*-208*f* and 208*c*-208*d*.

Figure 5A:
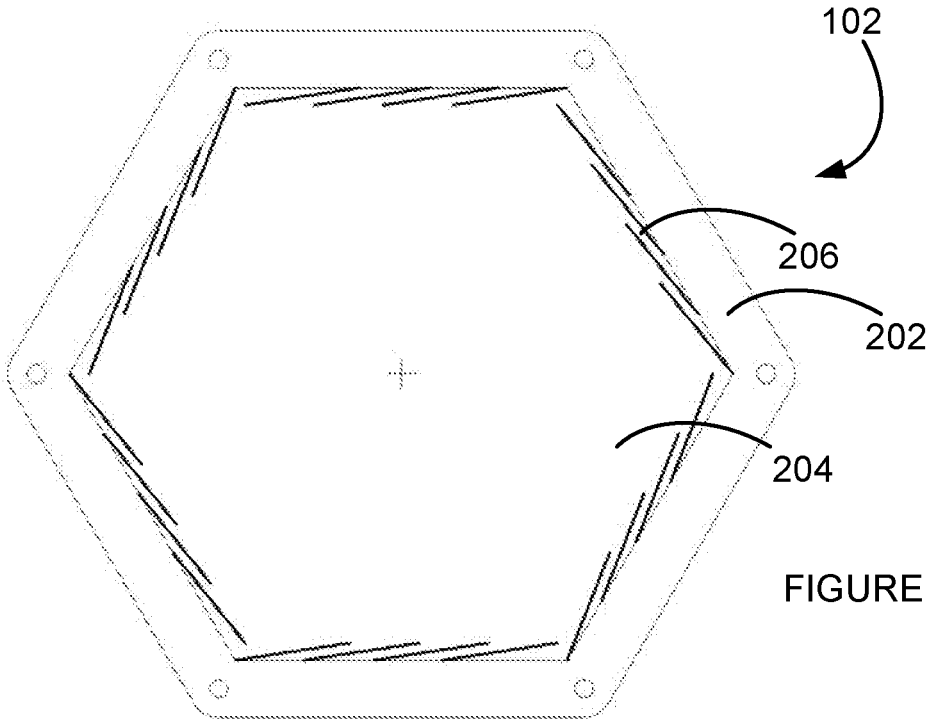
FIG. 5A shows an alternate example of the diaphragm, according to an aspect of the present disclosure.
Figure 5B:
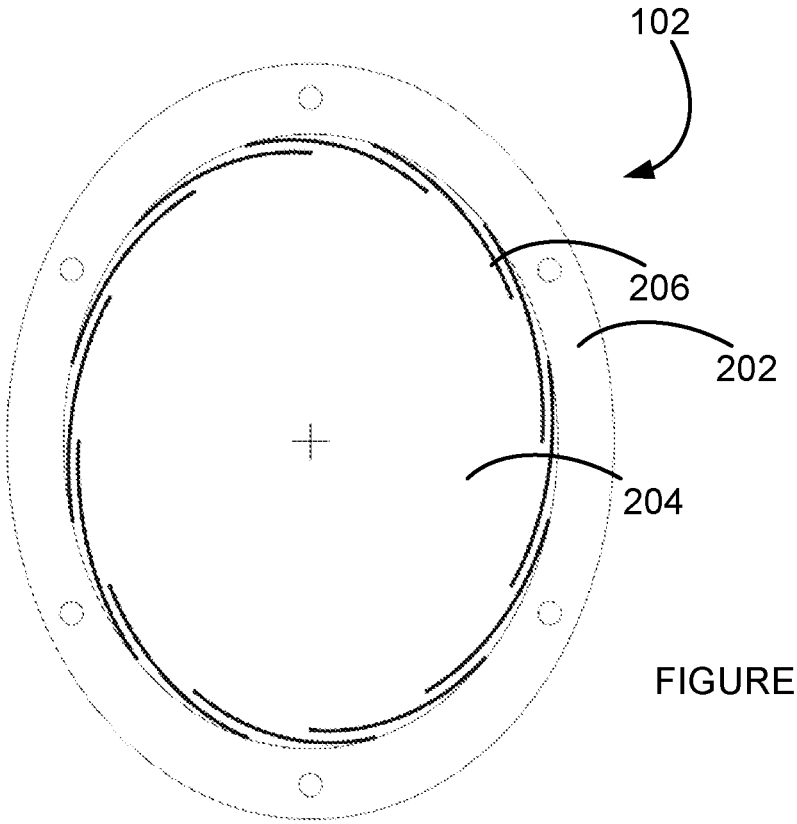
FIG. 5B shows yet another alternate example of the diaphragm, according to an aspect of the present disclosure.
Figure 5C:
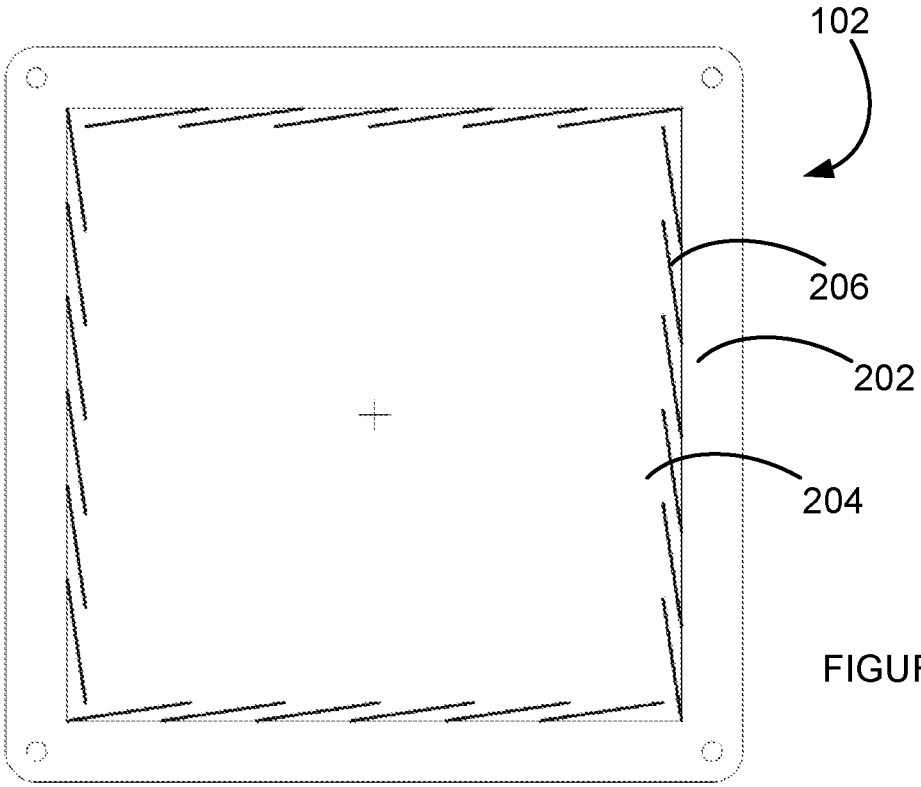
FIG. 5C shows yet another alternate example of the diaphragm, according to an aspect of the present disclosure.
Figure 5D:
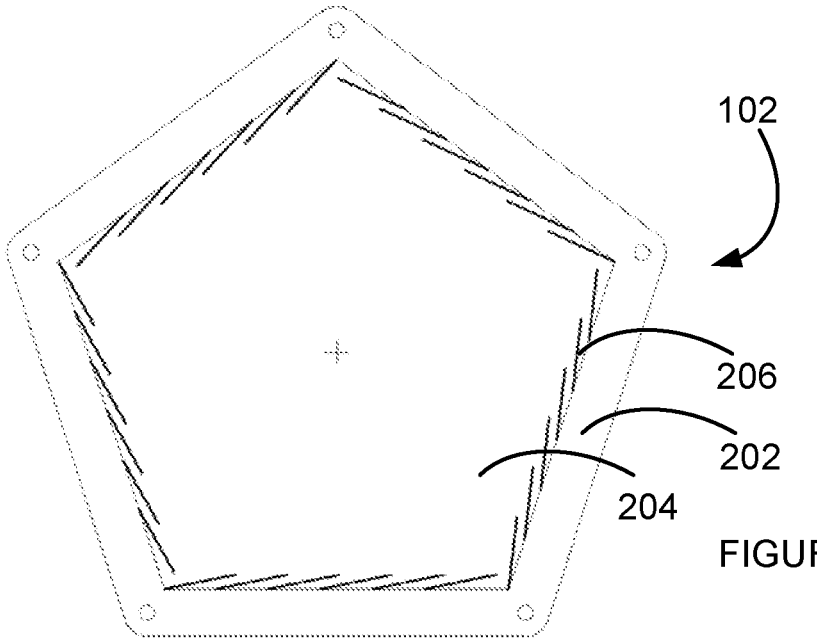
FIG. 5D shows yet another alternate example of the diaphragm, according to an aspect of the present disclosure.
Figure 5E:
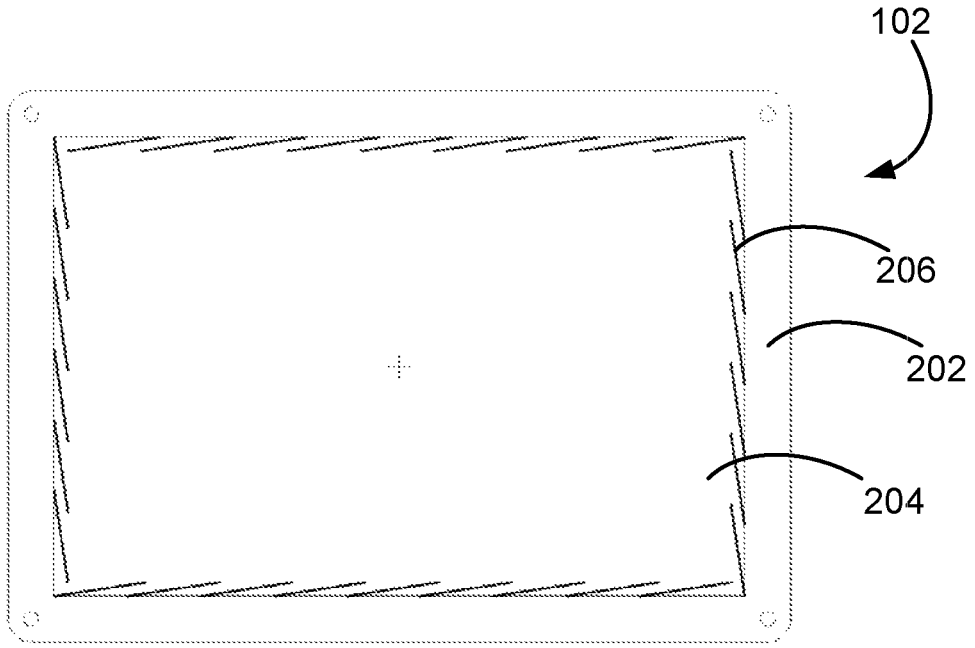
FIG. 5E shows yet another alternate example of the diaphragm, according to an aspect of the present disclosure.
Figure 5F:
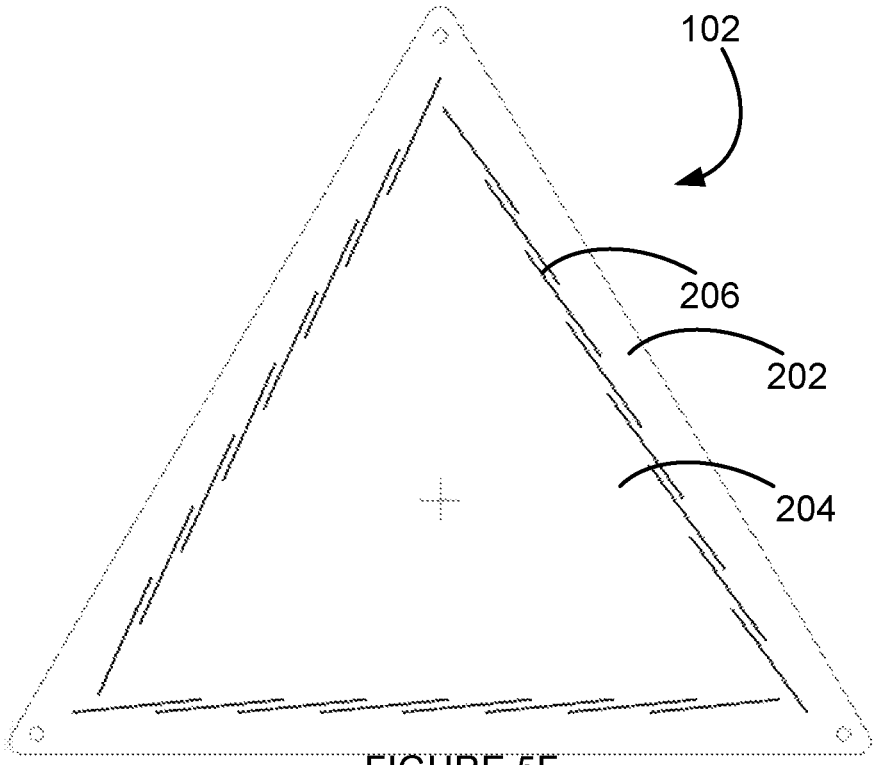
FIG. 5F shows yet another alternate example of the diaphragm, according to an aspect of the present disclosure.

In the foregoing example, the shape of the diaphragm described with reference to loudspeaker 100 was substantially circular. However, the shape of the diaphragm may be different than a circular shape. For example, other shapes with a high axial symmetry may be used. For example, FIG. 5A shows an example diaphragm 102 in a hexagonal shape, with a plurality of leaf springs 206 separating the fixed portion 202 and the movable portion 204. FIG. 5B shows an example diaphragm 102 in a oval shape, with a plurality of leaf springs 206 separating the fixed portion 202 and the movable portion 204. FIG. 5C shows an example diaphragm 102 in a square shape, with a plurality of leaf springs 206 separating the fixed portion 202 and the movable portion 204. FIG. 5D shows an example diaphragm 102 in a pentagon shape, with a plurality of leaf springs 206 separating the fixed portion 202 and the movable portion 204. FIG. 5E shows an example diaphragm 102 in a rectangle shape, with a plurality of leaf springs 206 separating the fixed portion 202 and the movable portion 204. FIG. 5F shows an example diaphragm 102 in a triangle shape, with a plurality of leaf springs 206 separating the fixed portion 202 and the movable portion 204.

Figure 6:
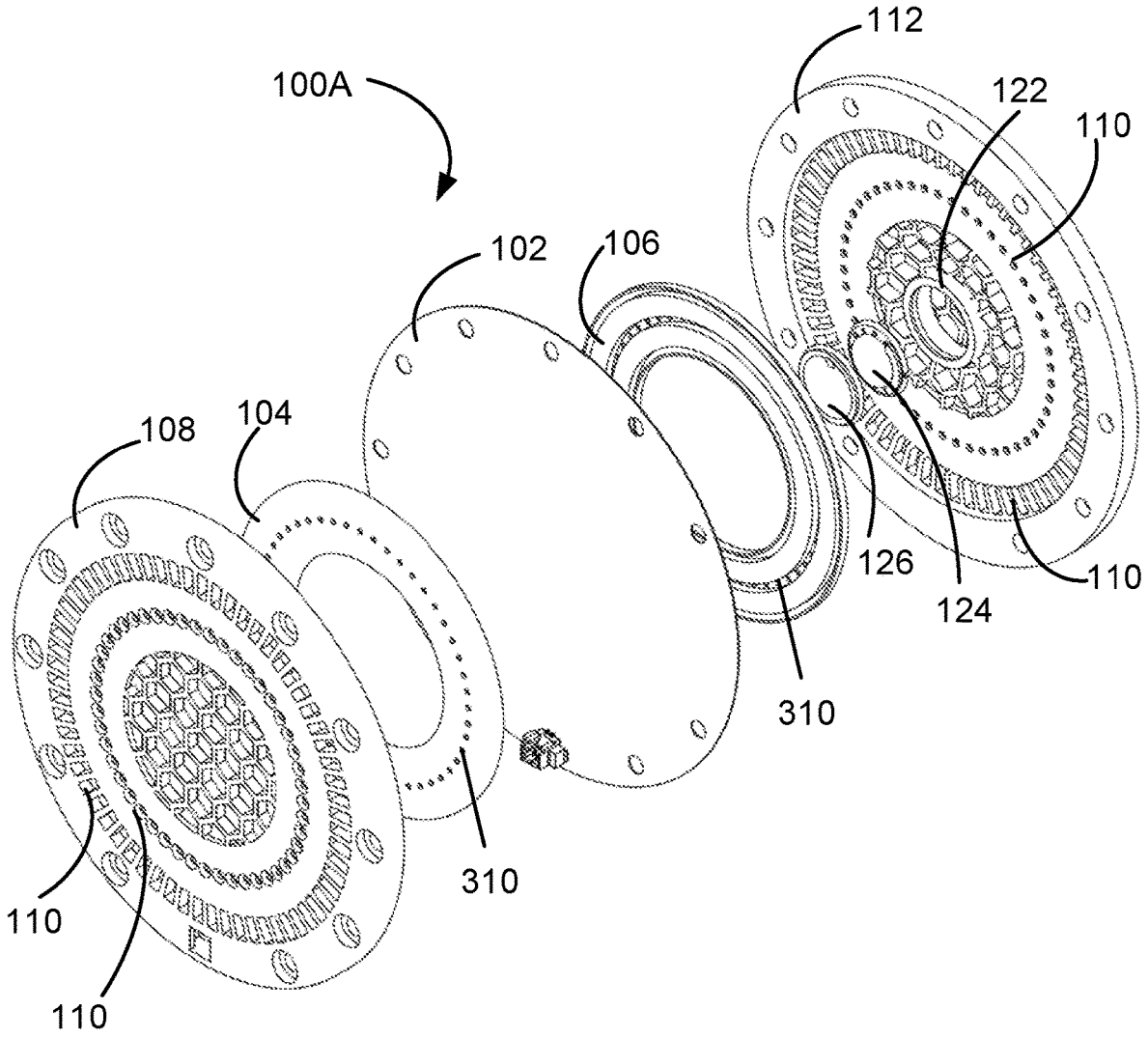
FIG. 6 shows another example loudspeaker, according to an aspect of the present disclosure.

FIG. 6 shows an exploded view of another example loudspeaker 100A. The loudspeaker 100A is similar to the loudspeaker 100 described with reference to FIG. 1, however, the loudspeaker 100A uses top magnet assembly 104 and bottom magnet assembly 106 with through holes 310 as previously described with reference to FIG. 3D. Further, loudspeaker 100A integrates a tweeter 124 in the bottom receiver cover 112 disposed over the bottom magnet assembly 106.

In this example, the bottom receiver cover 112 has a cavity 122. The cavity 122 is disposed substantially in the center of the bottom receiver cover 122. The cavity 122 is configured to receive the tweeter 124. A cover 126 is configured to secure the tweeter 124 inside the cavity 122. In one example, the cover 126 is configured to be press fit into the cavity 122.

In one example, the top receiver cover 108 and bottom receiver cover 112 have a plurality of holes 110 that correspond to the through holes 310 of the top magnet assembly 104 and the bottom magnet assembly 106.

As one skilled in the art appreciates, generally is configured to receive a high frequency portion of the input signal to be reproduced by the tweeter. An example filter circuit 600 used to divide the input signal is shown in FIG. 6A.

Figure 6A:
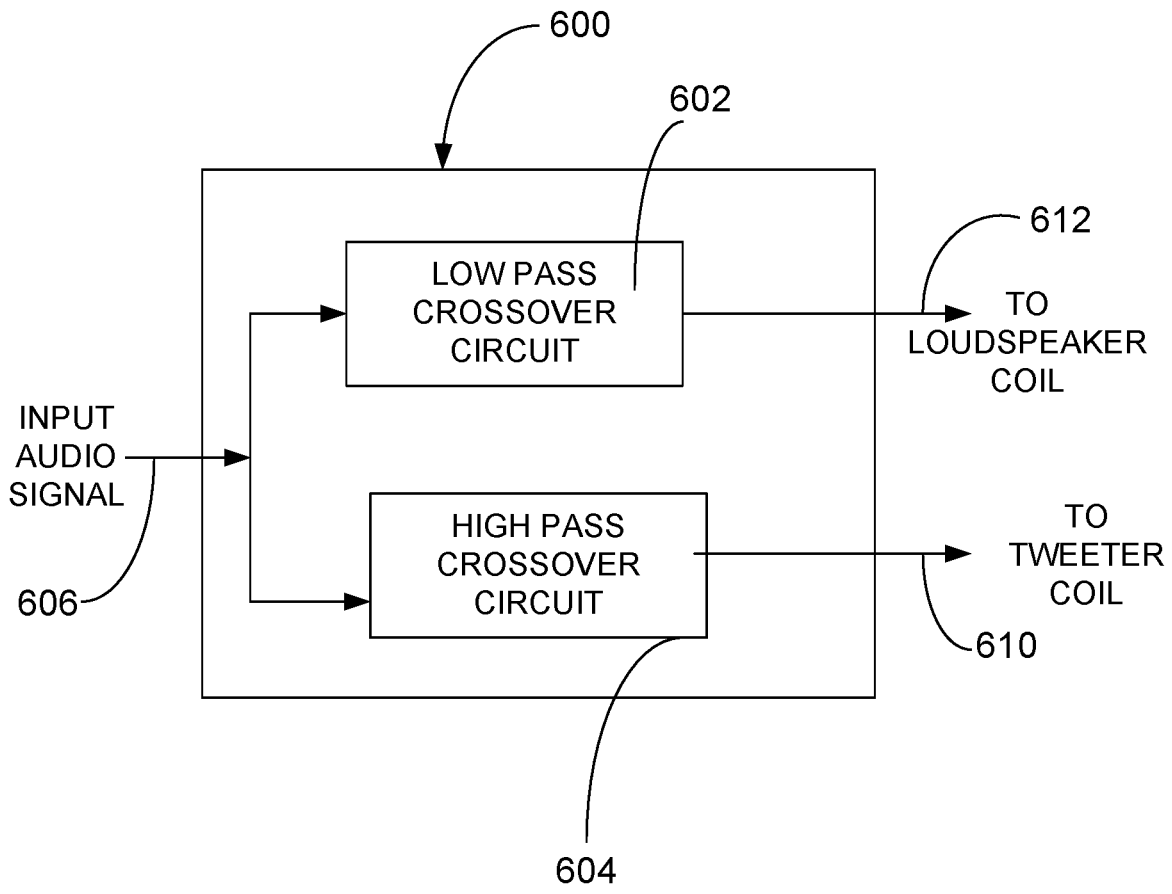
FIG. 6A shows an example filter circuit for use with the loudspeaker of FIG. 6, according to an aspect of the present disclosure.

Now, referring to FIG. 6A, an example filter circuit 600 is shown. The filter circuit 600 includes a low pass crossover circuit 602 and a high pass crossover circuit 604. The filter circuit 600 receives the input audio signal over signal line 606 and fed to both the low pass crossover circuit 602 and the high pass crossover circuit 604 as input. The low pass crossover circuit 602 and high pass crossover circuit 604 may be constructed using passive devices or active devices, as is well known in the art. The filter circuit 600 may be conveniently placed inside the loudspeaker of this disclosure. For example, the filter circuit 600 may be placed in a slot inside the top receiver cover 108 of the loudspeaker previously described. In one example, the filter circuit 600 may also be formed on the diaphragm 102 of the loudspeaker. In one example, the filter circuit 600 may be conveniently formed on the fixed portion 202 of the diaphragm 102.

The low pass crossover circuit 602 is configured to substantially filter out (or attenuate) received input signal above a certain cutoff frequency, say CF1 and pass any input signal below the cutoff frequency of CF1 without much attenuation, The output of the low pass crossover circuit received over signal line 608 is fed to the coils of the diaphragm of the loudspeaker, to reproduce a portion of the input audio signal as sound waves. As one skilled in the art appreciates, the portion of the input audio signal reproduced by the diaphragm of the loudspeaker primarily corresponds to the low frequency component of the input signal, below the cutoff frequency CF1.

The high pass crossover circuit 604 is configured to filter out (or attenuate) received input signal below the cutoff frequency CF1 and pass any input signal above the cutoff frequency CF1 without much attenuation. The output of the high pass crossover circuit received over signal line 610 is fed to the coils of the tweeter, to reproduce a portion of the input audio signal as sound waves. As one skilled in the art appreciates, the portion of the input audio signal reproduced by the tweeter primarily corresponds to the high frequency component of input signal, above the cutoff frequency CF1.

Figure 6B:
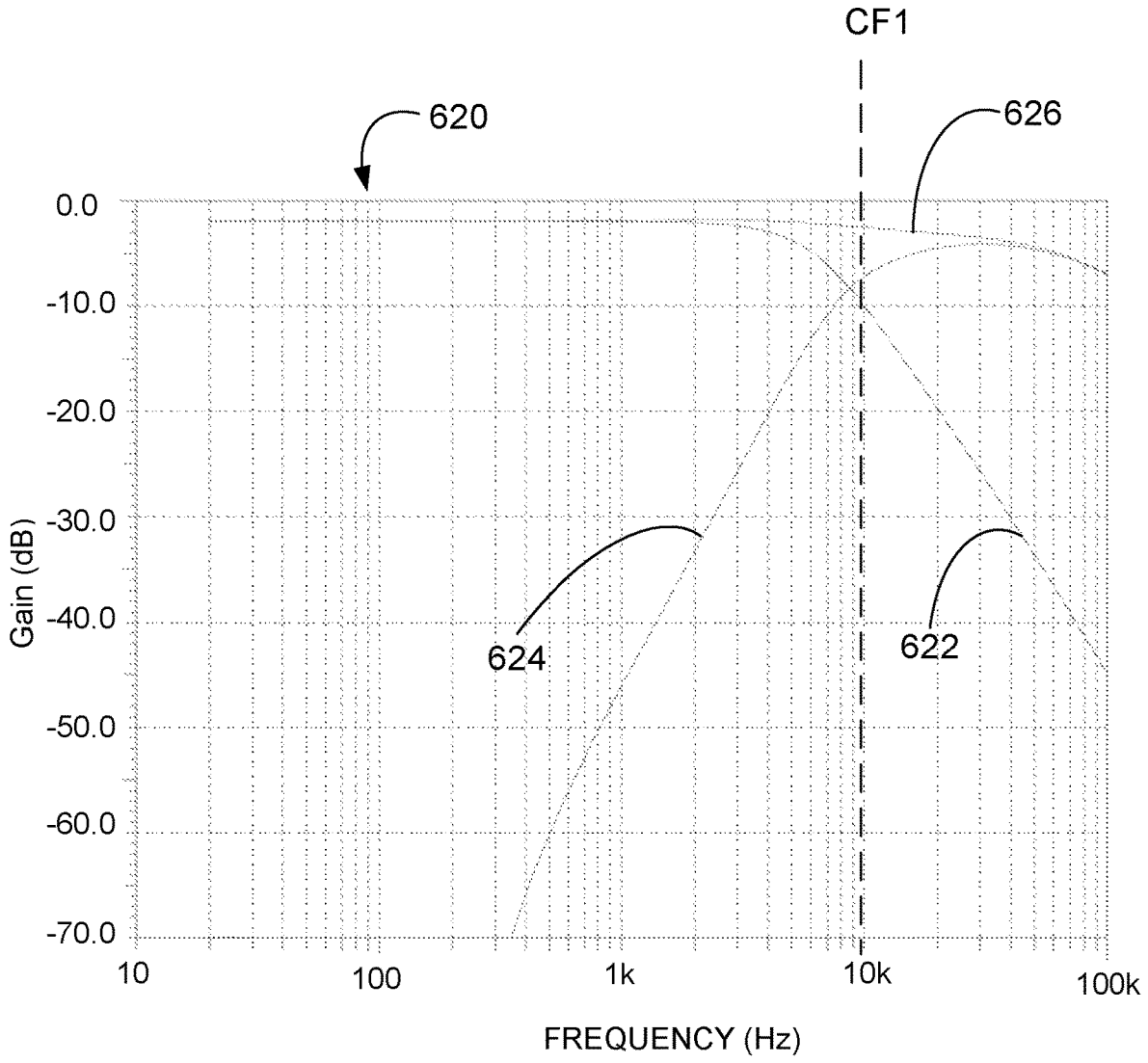
FIG. 6B shows an example graph showing the output of the filter circuit of FIG. 6A, according to an aspect of the present disclosure.

Now, referring to FIG. 6B, an example graph 620 is shown. The X axis of the graph 610 shows frequency in Hz (on a log scale). Y axis of the graph shows gain in decibels (dB). As one skilled in the art appreciates, the gain is shown as a negative number, which corresponds to the attenuation of the input signal. In this example graph, the cutoff frequency CF1 is around 10 KHz. Line 622 shows output of the low pass crossover circuit 602 over a range of frequencies. In this example, the output of the low pass crossover circuit remains substantially constant below the crossover frequency CF, attenuates by about 10 dB around the crossover frequency CF1 and decreases as the input frequency increases. Line 624 shows output of the high pass crossover circuit over a range of frequencies. In this example, the output of the high pass crossover circuit slowly raises, as the input frequency reaches towards the crossover frequency CF1 and remains substantially constant above the crossover frequency CF1. Line 626 shows a cumulative output of the loudspeaker with the tweeter. As one skilled in the art appreciates, the output remains substantially constant over a wide range of frequency.

Design Considerations and Example Calculations:

Following design considerations and calculations are provided as example only and are not intended to limit the scope of the disclosure herein.

The voice-coil in the moving coil loudspeaker drivers considered here are suspended in a magnetic field, the air-gap, of the magnet assembly such that current flow thorough the voice-coil gives rise to a Lorentz force acting on the voice-coil normal to the plane of the diaphragm causing it to respond with vibrational motion and hence emit sound, when an AC signal voltage in the audio band is applied to the voice-coil.

The following, which is taken from A Parametric Study of Magnet System Topologies for Micro-speakers by Hiebel (130 AES Convention 13-16 May 2011), gives the equations and methodology for calculating a loudspeaker driver's power sensitivity $E_p$, the Sound Pressure Level, SPL measured in decibels (dB) at 1 m for 1 W power input:

$$E_p=\text{SPL}=20\cdot\log_{10}((S_d\cdot\delta_a\cdot BL)/(2\pi\cdot M_{ms}\cdot\sqrt{R_e}\cdot 20e^{-6}))\ \text{dB 1 W/1 m}$$

where, $S_d$ Effective area of loudspeaker diaphragm, ($m^2$)

$\delta_a$ Density of air at standard temperature and pressure (1.225 $kgm^{-2}$)

BL B.L motor force product, (Tm)

B is the average magnetic flux density in the voice-coil air-gap, (T)

L is the length of voice-coil conductor in the air-gap, (m)

$M_{ms}$ Total moving mass of diaphragm+voice-coil (+suspension) (kg)

$R_e$ Voice-coil DC resistance, or more typically impedance at 1 kHz (Ω)

$20e^{-6}$ SPL scaling relative to threshold of hearing 20 μPa

SPL Sound Pressure in decibels measured at 1 meter/1 Watt (dB 1 W/1 m)

$E_p$ SPL power sensitivity (dB 1 W/1 m)

In the expression, the voice-coil resistance $R_e$, and conductor length in the air-gap L, are interdependent and the expression can be rewritten using the following identities for the voice-coil conductor material:

$$R_e=\rho_r\cdot L/A$$

$$m_{vc}=\delta_m\cdot L\cdot A$$

where, $\rho_r$ Resistivity of voice-coil conductor material (Cu 1.68E−08 Ωm, Al 2.82E−08 Ωm)

$\delta_m$ Density of voice-coil material (Cu 8.96E+03 $kgm^{-3}$, Al 2.70E+03 $kgm^{-3}$)

$m_{vc}$ Mass of the voice-coil (kg)

L L is the length of voice-coil conductor in the air-gap, (m)

A Cross-sectional area of conductor, ($m^2$)

$m_s$ Mass (effective) of the diaphragm (kg)

which in turn gives the following expression for $\sqrt{R_e}$ allowing the elimination of L, $$\sqrt{R_e}=(\sqrt{\rho_r}\cdot\sqrt{\delta_m}\cdot L)/\sqrt{m_{vc}}$$

$$M_{ms}=(m_{vc}+m_s)$$

to give:

$$E_p=\text{SPL}=20\cdot\log_{10}((S_d\cdot\delta_a\cdot B\cdot\sqrt{m_{vc}})/(2\pi\cdot(m_{vc}+m_s)\cdot\sqrt{\rho_r}\cdot\sqrt{\delta_m}\cdot 20e^{-6}))\ \text{dB 1 W/1 m}$$

A given diaphragm area and magnet geometry effectively sets $S_d$ and B as constant making $m_{vc}$ and $m_s$ the only variables allowing the expression to take the following form:

$$E_p=\text{const.}+20\cdot\log_{10}(\sqrt{m_{vc}}/(m_{vc}+m_s))$$

which has a unique maximum value when $m_{vc}=m_s$, giving a final form of the expression as follows:

$$(E_p)_{max}=(\text{SPL})_{max}=20\cdot\log_{10}((S_d\cdot\delta_a\cdot B)/(4\pi\cdot\sqrt{m_s}\sqrt{\rho_r}\cdot\sqrt{\delta_m}\cdot 20e^{-6}))\ \text{dB 1 W/1 m}$$

A desirable configuration for a loudspeaker driver for a given magnet geometry and voice-coil conductor material, typically Copper or Aluminum, depends therefore primarily on the effective area, $S_d$ and mass, $m_s$ of the diaphragm. And once the diaphragm is chosen, generally to be as light and stiff (to bending) as possible based on acoustic and modal (vibration) considerations, then that optimal maximum SPL power efficiency is known immediately. The design process for a loudspeaker driver should be an attempt to achieve that optimal design within the physical constraints of the available voice-coil conductor materials, fabrication methods, and last but not least, budget.

The specific geometry and conductor material of the voice-coil will determine the voice-coil resistance $R_e$ (Ω) and hence the SPL voltage sensitivity $S_v$ (dB $1V_{rms}$/1 m) which is the sound pressure level measured at 1 m for 1.0 $V_{rms}$ input. There is also the practical consideration that audio amplifiers are designed and built to drive specific impedances with well-defined output power and RMS voltage ratings, which means that the power rating of the voice-coil is an important design consideration. Typical voice-coil impedances are 4Ω, 8Ω or 16Ω for general purpose loudspeaker drivers with power ratings in 10s to 100s of Watts, while for microspeakers used in mobile devices the impedances are in the same range but the power ratings are in the range of 1 to 3 Watts. For headphones, earbuds and in-ear monitors the impedances are typically 24Ω, 32Ω and up to as much as 300 Ω while the power ratings are significantly relaxed to typically 10s to 100s of mW.

Here is a summary of these expressions in forms useful for loudspeaker driver optimization:

$$E_p=\text{SPL}=20\cdot\log_{10}((S_d\cdot\delta_a\cdot BL)/(2\pi\cdot M_{ms}\cdot\sqrt{R_e}\cdot 20e^{-6}))\ \text{dB 1 W/1 m}$$

$$E_p=\text{SPL}=20\cdot\log_{10}((S_d\cdot\delta_a\cdot B\cdot\sqrt{m_{vc}})/(2\pi\cdot(m_{vc}+m_s)\cdot\sqrt{\rho_r}\cdot\sqrt{\delta_m}\cdot 20e^{-6}))\ \text{dB 1 W/1 m}$$

$$(E_p)_{max}=(\text{SPL})_{max}=20\cdot\log_{10}((S_d\cdot\delta_a\cdot B)/(4\pi\cdot\sqrt{m_s}\sqrt{\rho_r}\cdot\sqrt{\delta_m}\cdot 20e^{-6}))\ \text{dB 1 W/1 m}$$

where $M_{ms}=m_{vc}+m_s$ and at $(E_p)_{max}$, $m_{vc}=m_{ms}$, ==>$M_{ms}=2\cdot m_s=2\cdot m_{vc}$ SPL==>Power Efficiency or Power Sensitivity $E_p$ (dB 1 W/1 m)

==>Voltage Sensitivity $S_v$ (dB $1V_{rms}$/1 m)

To convert from one to the other, following expressions are used.

$$S_v=E_p-10\cdot\log_{10}(R_e)\ \text{dB}\ 1V_{rms}/1\ \text{m}$$

$$E_p=S_v+10\cdot\log_{10}(R_e)\ \text{dB 1 W/1 m}$$

These expressions are generally the same for the dynamic loudspeaker drivers used for headphones, in-ear monitors and earbuds. However, the headphone power sensitivity is normally related to the SPL at the ear for 1 mW input power. As a useful guide for comparing headphone drivers with conventional loudspeaker drivers, the following expression converts SPL at 1 m to SPL at 1 cm:

$$E_p\ \text{dB (1 mW/1 cm)}=10\ \text{dB}+E_p\ \text{dB (1 W/1 m)}$$

And again for headphones, to convert from $E_p$, the power sensitivity SPL at 1 mW to $S_v$, the voltage sensitivity for $1V_{rms}$ at the ear, the following expressions apply:

$$S_v=E_p+(30-10\cdot\log_{10}(R_e))\ \text{dB/V at the ear}$$

$$E_p=S_v-(30-10\cdot\log_{10}(R_e))\ \text{dB/mW at the ear}$$

With these expressions in hand we can set about an example implementation of an improved loudspeaker driver which can generally be used at all sizes but for which we give an exemplary design methodology for large diaphragm high performance headphone drivers.

Voice-Coil and Suspension for a Near 'Ideal Force'

A planar voice-coil over the entire area of the diaphragm would satisfy the requirement for an isotropic diaphragm structure. This can be achieved with the planar voice-coil loudspeakers, which date back more than fifty years, (U.S. Pat. Nos. 3,013,905A, 3,674,946, 3,829,623) and have planar voice-coils with 70%-90% the diaphragm area, $S_d$. But they have two failings, 1) The isodynamic drive of the tensioned film diaphragms leads to a substantially planar sound wave-front which gives rise to unacceptably narrow directivity for general use other than headphones and 2) the planar magnet structure extends over the entire diaphragm area, is heavy and needs to be perforated, all adding expense.

These failings are overcome in this disclosure by using a composite sandwich panel to fabricate the diaphragm where the planar voice-coil material is part of the sandwich panel skins and is mechanically isotropic over the entire area of the diaphragm.

The term mechanically isotropic means that the mechanical impedance of the diaphragm remains constant over some minimum scale. The mechanical impedance $Z_m$, is a panel material property given by $Z_m=8\sqrt{(B\cdot\mu)}$ where B is the bending stiffness (Nm) and μ is the aerial density ($kgm^{-2}$) of the diaphragm. (For a monolith panel, $B=E\cdot t^3/(12\cdot(1-v^2))$ where E is the panel material's tensile modulus, t the panel thickness, v its Poisson ratio and $\mu=\rho\cdot t$ where ρ is the volume density.) So provided this product (B·μ) is kept constant on the chosen scale then the panel will be mechanically isotropic. The ability to fabricate any 2D structure including the voice-coil in the Copper (or Aluminum) metal cladding of the FPC (flex printed circuit) composite panel skins, facilitates the process of ensuring that $Z_m$ can be kept constant on a suitable scale of less than 10% of the diaphragm diameter D (=68.4 mm) which is 3.5 mm to 7 mm for our exemplary circular diaphragm. In particular, features of increased or lowered stiffness and mass, relative to the voice-coil area, can be etched in the Copper (or Aluminum) foil in the surface regions outside the magnet assembly without adding cost. And the thicknesses of Copper (or Aluminum) foil and polyimide (or PET/polyester) substrate used can be chosen to facilitate that objective of isotropic $Z_m$ on the chosen scale of less than 10% D.

For example, consider a sandwich panel comprising thin skins, 12.5 μm, high tensile modulus (7.1 GPa) polyimide film substrate, 8.7 μm copper foil clad and bonded on both sides to a light density (32.0 $kgm^{-3}$) core, typical thickness 1.0 mm ROHACELL®-IG31. This gives an exemplary composite sandwich panel with a suitable high bending stiffness diaphragm with diameter D=68.2 mm, surface area $S_d$=3563 $mm^2$ and mass $m_s$=0.29 g (excluding mass $m_{vc}$ of voice-coil). The other mechanical properties of this exemplary panel diaphragm relevant to bending wave loudspeakers are: B, bending stiffness=0.0568 Nm, $f_o$, fundamental mode frequency=724.3 Hz and $f_c$, coincidence frequency=21.8 kHz, $Z_m$ mechanical impedance=0.539 $Nsm^{-1}$.

Compared to the planar voice-coil loudspeakers previously known, the magnet surface area and active planar voice-coil area of this example disclosure is substantially reduced from 70%-90% $S_d$ to about 30%-45% $S_d$ which means that the planar magnet assembly does not need to be perforated as there is a wide open sound radiation area (70%-60%) on both sides of the diaphragm. The active planar voice-coils in the example are made axisymmetric and centered on the fundamental mode ($f_o$) nodal radius $r_o$, at 0.68a=23.1 mm (where a=34.1 mm is the diaphragm radius) so that the resolved force on the diaphragm in effect, acts at the center point in such a way as to preserve the isotropic modal structure resulting in a near 'ideal loudspeaker' save for the effective mass of the diaphragm suspension.

In order to achieve a near 'ideal loudspeaker' concept with a near 'ideal force', an isotropic diaphragm with a suspension with zero effective mass is desirable. In one example, an integral multi-leaf cantilevered suspension system is constructed by cutting into the diaphragm structure several narrow slots, for example, slots 8 to 16 in number, 0.10 mm to 0.5 mm in width, 10 mm to 30 mm in length, in a spiral format, at an acute angle less than 15°, on the periphery of the exemplary diaphragm diameter D=68.2 mm, radius a=34.1 mm, $S_d$=3563 $mm^2$. To isolate front from rear sound pressure radiation, the slots are filled with a viscous material such as high vacuum silicone grease or ultralow Durometer rubber, for example silicone Room Temperature Vulcanized (RTV) hardness Shore00 11 to 30 allowing for sufficient diaphragm displacement together with viscoelastic damping at the diaphragm edge.

The sandwich panel skins can be made with standard flex printed circuit (FPC) fabrication techniques using commercially available high performance copper clad polyimide such as PANASONIC® FELIOS® R-F775 (8.7 μm to 17.4 μm Cu foil on 12.7 μm to 25.4 μm polyimide substrate) material on the one hand or on the other hand, made with standard RFID antenna fabrication techniques using Aluminum (5 μm to 10 μm) clad PET/polyester films (5 μm to 25 μm). Aluminum clad PET film fabrication is an order of magnitude inferior to modern copper clad FPC fabrication. So although a 3 dB SPL improvement—$((E_p)_{max}Al-(E_p)_{max}Cu)=-20\cdot\log_{10}((\sqrt{\rho_{al}}\cdot\sqrt{\delta_{al}})/(\sqrt{\rho_{cu}}\cdot\sqrt{\delta_{cu}}))$ dB (1 W/1 m)—is available from a fully optimized Aluminum clad PET film solution compared to the equivalent Copper clad polyimide film FPC solution, practical considerations dictate a copper clad FPC solution as the most viable and cost effective at present.

Photo chemical etching fabrication process used to make FPC and RFID antenna type coils which are technologies that can be utilized to make the structural diaphragms of this disclosure. Printed Electronics technology and Laser cutting/etching are also viable technologies available today to create the coils and the slots respectively. In some examples, isotropic graphene skin based composite sandwich panel diaphragms can be fabricated using laser cutting to provide structured electromechanical sandwich panels with increased stiffness for the skins and reduced areal density for the mechanical properties of the panel, as well as increased conductivity for the laser cut planar voice-coils, leading to even higher maximum SPL from this disclosure. This is evidenced by the parametric expression for maximum SPL power sensitivity:

$$(E_p)_{max}=(\mathrm{SPL})_{max}=20\cdot\log_{10}((S_d\cdot\delta_d\cdot B)/(4\pi\cdot\sqrt{m_s}\sqrt{\rho_r}\cdot\sqrt{\delta_m}\cdot 20e^{-6}))\ \mathrm{dB}\ 1\ \mathrm{W}/1\ \mathrm{m}$$

where the key material parameters are the $(m_s\cdot\rho_r\cdot\delta_m)$ product. Graphene, with its high stiffness to weight ratio and high electrical conductivity drives all three of these parameters in the direction of increased max SPL compared to polyimide or PET as a substrates and Copper or Aluminum as conductors.

Integrating both the planar voice-coil and the multi-leaf cantilevered suspension system into the sandwich panel diaphragm thus gives rise to a mechanically isotropic electromechanical structure resulting in a Flat Panel Diaphragm Loudspeaker driver which has a substantially flat on-axis pressure response, wide directivity, as well as a smooth and extended power response over the entire audio band—a near 'ideal loudspeaker'.

An Example Large Diaphragm Headphone Driver

Large diaphragm, (typically diameter 40 mm to 70 mm) dynamic headphone drivers are considered for the very best headphones which tend to be circumaural or over the ear headphones. The design target objective was to use this disclosure to provide markedly improved cost performance at this high end of the headphone market. The headphone drivers made using this disclosure are very light and compact and the same size chosen could also be used for smaller supraaural or on the ear headphones. The Diaphragm diameter D=68.2 mm considered here by example can be scaled down and optimized for a smaller diaphragm for use with supraaural headphones.

The diameter D=68.2 mm, radius a=34.1 mm, chosen has a mean fundamental mode ($f_o$) nodal radius at 0.68a=23.1 mm. This radius, $r_o$=23.1 mm, determines the central radius of the planar magnet structure. PANASONIC® FELIOS® F-R775 was chosen for the sandwich panel skins because it is one of the most advanced FPC fabrication materials on the market. It is a copper clad polyimide which has a high tensile modulus of 7.1 GPa and a density of 1.46 $kgm^{-3}$. It is available in a range of sizes and specifications as shown in Table 1 below. In Table 1, an "○" indicates "available" and a "-" indicates "not available".

TABLE 1

| Copper Foil Thickness | | RA Copper Foil - PANASONIC ® FELIOS ® R-F775 Film Thickness | | | | | | | | |
|---|---|---|---|---|---|---|---|---|---|---|
| | | 0.5 mil | 0.59 mil | 0.8 mil | 1 mil | 2 mils | 3 mils | 4 mils | 5 mils | 6 mils |
| Oz | μm | .013 mm | .015 mm | .02 mm | .025 mm | .05 mm | .075 mm | .1 mm | .125 mm | .15 mm |
| ¼ | 9 | o | o | o | O | o | — | — | — | — |
| ⅓ | 12 | o | o | o | O | o | — | — | — | — |
| ½ | 18 | o | o | o | O | o | o | o | o | o |
| 1 | 35 | o | o | o | O | o | o | o | o | o |
| 2 | 70 | o | o | o | O | o | o | o | o | o |
| 3 | 105 | — | — | — | — | o | — | — | — | — |
| 4 | 150 | — | — | — | — | o | — | — | — | — |

ROHACELL® which is a Polymethacrylimide (PMI) based, rigid, closed-cell polymeric foam used extensively in the aerospace industry, was chosen as the core material for the sandwich panels made with the FELIOS® F-R775 FPC skins. Due to its exceptional mechanical properties of being very light and stiff with good internal damping, ROHACELL® makes for excellent bending wave loudspeaker panels. Table 2 below shows various properties of ROHACELL® polymeric foam.

TABLE 2

| Properties | Unit | ROHACELL ® 31 IG/IG-F | ROHACELL ® 51 IG/IG-F | ROHACELL ® 71 IG/IG-F | ROHACELL ® 110 IG/IG-F |
|---|---|---|---|---|---|
| Density | kg/m3 | 32 | 52 | 75 | 110 |
| Compressive strength | MPa | 0.4 | 0.9 | 1.5 | 3 |
| Tensile strength | MPa | 1 | 1.9 | 2.8 | 3.5 |
| Shear strength | MPa | 0.4 | 0.8 | 1.3 | 2.4 |

TABLE 2-continued

| Properties | Unit | ROHACELL ® 31 IG/IG-F | ROHACELL ® 51 IG/IG-F | ROHACELL ® 71 IG/IG-F | ROHACELL ® 110 IG/IG-F |
|---|---|---|---|---|---|
| Elastic modulus | MPa | 36 | 70 | 92 | 160 |
| Shear modulus | MPa | 13 | 19 | 29 | 50 |
| Elongation at break | % | 3 | 3 | 3 | 3 |

The mechanical properties of the sandwich panels were derived from the following calculation table, Table 3:

TABLE 3

| | | | |
|---|---|---|---|
| $t_c$, thickness (PMI/ROHACELL ®) 31 IG core | 500 μm | 750 μm | 1000 μm |
| $t_s$, thickness (FELIOS ® R-F775) skin | 12.7 μm | 12.7 μm | 12.7 μm |
| $t_g$, thickness (3M 82600 PSA) glue | 5 μm | 5 μm | 5 μm |
| $t_p$, total panel thickness | 535 μm | 785 μm | 1035 μm |
| $E_s$, tensile elastic modulus skin | 7.1 GPa | 7.1 GPa | 7.1 GPa |
| $E_g$, tensile elastic modulus glue | 100 MPa | 100 MPa | 100 MPa |
| $E_c$, tensile elastic modulus core | 36 MPa | 36 MPa | 36 MPa |
| B, bending stiffness, $=B_s + B_g + B_c$ | 0.0144 Nm | 0.0319 Nm | 0.0568 Nm |
| $\rho_c$, density core | 32 $Kgm^{-3}$ | 32 $Kgm^{-3}$ | 32 $Kgm^{-3}$ |
| $\rho_s$, density skin | 1460 $Kgm^{-3}$ | 1460 $Kgm^{-3}$ | 1460 $Kgm^{-3}$ |
| $\rho_g$, density glue | 1200 $Kgm^{-3}$ | 1200 $Kgm^{-3}$ | 1200 $Kgm^{-3}$ |
| μ, panel aerial density | 0.064 $Kgm^{-2}$ | 0.072 $Kgm^{-2}$ | 0.080 $Kgm^{-2}$ |
| $S_d$, panel area | 3653 $mm^2$ | 3653 $mm^2$ | 3653 $mm^2$ |
| c, velocity sound in air | 340 $ms^{-1}$ | 340 $ms^{-1}$ | 340 $ms^{-1}$ |
| $Z_m$, mechanical impedance = $8\sqrt{(B \cdot \mu)}$ | 0.243 $Nsm^{-1}$ | 0.384 $Nsm^{-1}$ | 0.539 $Nsm^{-1}$ |
| $f_c$, coincidence frequency, = $(c^2/2\pi)\sqrt{(\mu/B)}$ | 38.8 kHz | 27.6 kHz | 21.8 kHz |
| $f_o$, fundamental mode, = $(\pi/S_d)\sqrt{(B/\mu)}$ | 407.7 Hz | 572.5 Hz | 724.3 Hz |
| $m_s$, panel mass | 0.23 g | 0.26 g | 0.29 g |

The following Table 4 shows a list of thin FELIOS® R-F775 polyimide panels which were used as single layer thin diaphragms with copper, on one or both sides of the diaphragm, chosen to optimize mass distribution.

TABLE 4

| Material | R-F775 4 mil | R-F775 2 mil | R-F775 1 mil | R-F775 0.5 mil |
|---|---|---|---|---|
| $t_p$, panel thickness | 101.60 μm | 50.80 μm | 25.40 μm | 12.70 μm |
| $m_s$ panel mass | 0.542 g | 0.271 g | 0.135 g | 0.068 g |
| B, bending stiffness | 0.00473 Nm | 0.00118 Nm | 0.000296 Nm | 0.000074 Nm |

Example Magnet Structure

The magnet assembly consists of two identical magnet sub-assemblies opposing each other. The magnet-sub assembly comprises two compression bonded (BNP-10) Neodymium ring magnets of the same width and with isosceles trapezoid (isosceles trapezium in UK English) cross-section at 45° within a magnet cup or a holder of low carbon steel. The planar structural voice-coil diaphragm is suspended symmetrically in the air-gap between the magnet sub-assemblies.

The central radius of the ring magnet sub-assembly is determined by the mean drive-point at the fundamental mode ($f_o$) node radius $r_o$ at 0.68a=23.1 mm (where a=34.1 mm is the diaphragm radius) of the circular panel of diameter D=68.2 mm. The magnet width $w_m$=5.25 mm is chosen such that the total active planar magnet area (x %) is between 30%-45% of the diaphragm area $S_d$ given by $w_m$=x %($a^2/4 \cdot r_o$)=x %(0.184D). In this case $w_m$=5.25 mm is given by a magnet area x %=42% of the Diaphragm area, $S_d$. The magnet height $h_m$=1.5 mm and thickness $t_{cup}$=0.38 mm of the low carbon steel used to fabricate the magnet cup are optimized by FEA (finite element analysis) magnet simulation to minimize magnet material using a law of diminishing returns to get <B>, the average magnetic flux density within 5% of the maximum $\langle B \rangle_{max}$. Other magnet dimensions were thus chosen as follows: Inner ring magnet, inner diameter=36.0 mm, inner ring, outer diameter=outer ring, inner diameter=46.5 mm, outer ring, outer diameter=57.0 mm, and magnet cross-section is isosceles Trapezoid, 45° so that the opposing pole pieces have a width of 2.25 mm.

A two magnet sub-assembly was chosen empirically by FEA magnet computer simulation optimization to minimize the amount of magnet material used. It was observed that 1) two ring magnets give better performance (greater than 500% of motor force product BL) than one magnet with the same amount of material, 2) a material optimized three ring magnet sub-assembly of the same magnet area also has inferior performance to a two ring magnet optimized solution and, 3) the 45° isosceles trapezoid magnet structure not only facilitates easy location of the ring magnets within the steel cup but also provides improved linearity in the magnetic field within the air-gap traversed by the voice-coil and diaphragm.

Rectangular cross-section ring magnets with the same amount of material and the same magnet height in the same magnet cup gives similar results but fabricating and the locating the magnets in the cup is more difficult compared to the trapezoid section magnets whose position in the cup is uniquely defined by geometry. The following table, Table 5 shows the dimensions of the magnet sub-assembly for trapezoid and rectangular cross-section ring magnets which use the same cup and same mass of magnet materials.

TABLE 5

| Trapezoid and Rectangular ring magnets with equal average diameter and cross-sectional area | Tapezoid cross-section | Rectangular cross-section |
|---|---|---|
| magnet height, $h_m$ | 1.50 mm | 1.50 mm |
| magnet base width, $w_m$ | 5.25 mm | 3.75 mm |
| magnet pole piece width, wp | 2.25 mm | 3.75 mm |
| outer ring magnet outer diameter, D4 | 57.00 mm | 55.50 mm |
| outer ring magnet inner diameter, D3 | 46.50 mm | 48.00 mm |
| outer ring magnet average diameter, (D3 + D4)/2 | 51.75 mm | 51.75 mm |
| inner ring magnet outer diameter, D2 | 46.50 mm | 45.00 mm |
| inner ring magnet inner diameter, D1 | 36.00 mm | 37.50 mm |
| inner ring magnet average diameter, (D1 + D2)/2 | 41.25 mm | 41.25 mm |
| steel magnet cup inner diameter, D5 | 34.50 mm | 34.50 mm |
| steel magnet cup outer diameter, D5 | 58.50 mm | 58.50 mm |

Simulations Results

Simulations were carried out on two classes of diaphragm, 1) thin monolith panels using the FPC voice-coil fabricated on thin polyimide panels (see Table 4 for mechanical properties) and 2) ROHACELL® core sandwich panels with the FPC voice-coil fabricated on the polyimide skins of the panels (see Table 3 for mechanical properties). The results are presented in the following table, Table 6 and summarizes a sample of the simulation results obtained for magnet assemblies using compression bonded Neodymium magnets of BNP-10 strength.

TABLE 6

| | 2 Lyr ¼ oz ½ mil | Roh1 lyx 2½ oz ½ mil | Roh2 lyx 2¼ oz ½ mil | GP-2 Lyr ½ oz 4 mil | PE-4 Lyr 10 uAl 1 mil | |
|---|---|---|---|---|---|---|
| $S_d$ | 3.65E−03 | 3.65E−03 | 3.65E−03 | 3.65E−03 | 3.65E−03 | $m^2$ |
| $\rho_a$ | 1.225 | 1.225 | 1.225 | 1.225 | 1.225 | $kgm^{-3}$ |
| Bl | 0.99 | 2.1 | 2.1 | 1.97 | 2.03 | Tm |
| $M_{ms}$ | 1.30E−04 | 5.80E−04 | 5.80E−04 | 1.04E−03 | 2.60E−04 | Kg |
| $R_e$ | 25.1 | 25.4 | 25.4 | 25.1 | 26.8 | Ω |
| SPL | 94.68 dB | 88.16 dB | 88.16 dB | 82.59 dB | 94.59 dB | 1 W/1 m |

The power sensitivity results are converted from SPL at 1 W/1 m to SPL 1 mW/1 cm as shown in Table 7 below, in order to estimate the headphone sensitivity levels which correspond to SPL at the ear. These are then converted to voltage sensitivity levels (Voltage Sensitivity_Sv) for comparison with the typical data published on headphone sensitivities.

TABLE 7

| Simulation Model | Power Sensitivity_Ep | Impedance Re | X = 30 − 10*log10(Re) | Voltage Sensitivity_Sv |
|---|---|---|---|---|
| 1 Lyr ¼ oz ½ mil-BNP-10 | 104.7 dB/mW | 25.10 Ω | 16.0 dB | 120.7 dB/V |
| 1 Lyr ¼ oz ½ mil-Nd37 | 110.7 dB/mW | 25.10 Ω | 16.0 dB | 126.7 dB/V |
| 2 Lyr ¼ oz ½ mil-BNP-10 | 104.7 dB/mW | 25.10 Ω | 16.0 dB | 120.7 dB/V |
| 2 Lyr ¼ oz ½ mil-Nd37 | 110.7 dB/mW | 25.10 Ω | 16.0 dB | 126.7 dB/V |
| Roh1 lyx 2½ oz ½ mil-BNP-10 | 98.2 dB/mW | 25.40 Ω | 16.0 dB | 114.2 dB/V |
| Roh1 lyx 2½ oz ½ mil-Nd37 | 104.2 dB/mW | 25.40 Ω | 16.0 dB | 120.2 dB/V |
| Roh1 lyx 2¼ oz ½ mil-BNP-10 | 98.2 dB/mW | 25.40 Ω | 16.0 dB | 114.2 dB/V |
| Roh1 lyx 2¼ oz ½ mil-Nd37 | 104.2 dB/mW | 25.40 Ω | 16.0 dB | 120.2 dB/V |
| GP-2 Lyr ½ oz 4 mil-BNP-10 | 92.6 dB/mW | 25.10 Ω | 16.0 dB | 108.6 dB/V |
| GP-2 Lyr ½ oz 4 mil-ND37 | 98.6 dB/mW | 25.10 Ω | 16.0 dB | 114.6 dB/V |

The results shown here for a 68.2 mm diameter optimized large diaphragm headphone driver is one example, according to this disclosure. One expects that other sizes, both larger and smaller, can be scaled with the same cost performance benefits demonstrated with these results. For example, the data in column "Voltage Sensitivity_Sv" of Table 7 shows the SPL for various configurations.

The diaphragm disclosed in this disclosure, in some examples may be a planar diaphragm. In some examples, the diaphragm may be a panel form diaphragm. In some examples, the diaphragm may be a conical diaphragm. For example, a portion of the movable portion of the diaphragm may be shaped as a cone.

Figure 7A:
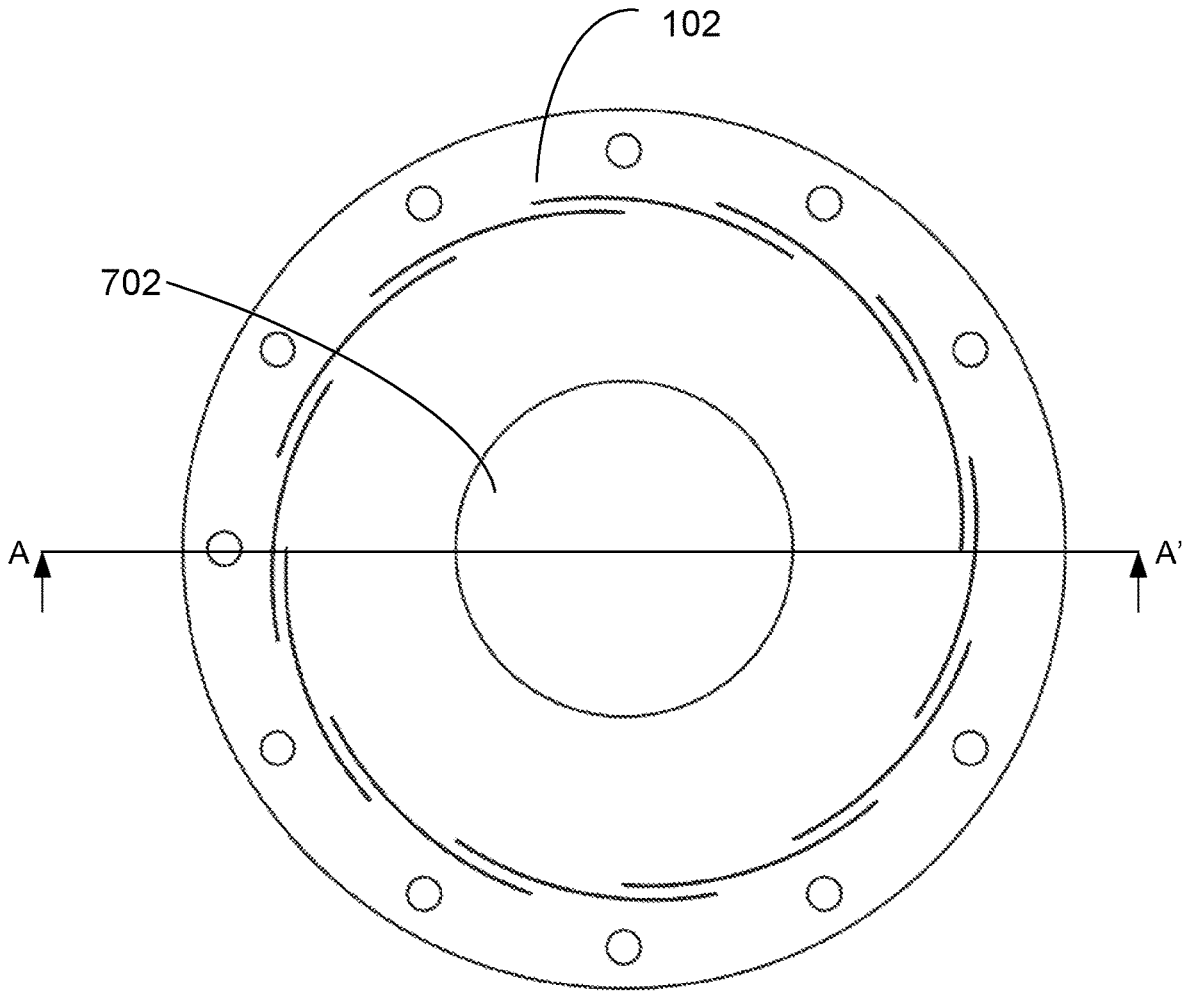
FIGS. 7A and 7B show an example diaphragm with a dome shaped central portion, according to an aspect of the present disclosure.
Figure 7B:
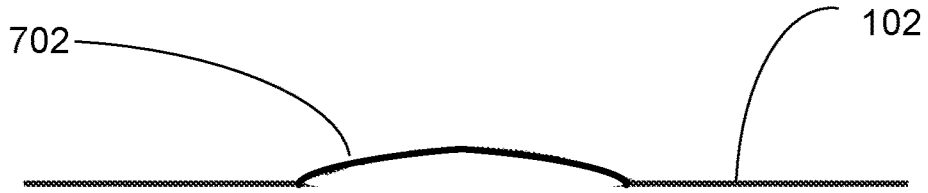

In some examples, the diaphragm may be a dome shaped diaphragm. For example, a portion of the movable portion of the diaphragm may be shaped as a dome. FIG. 7A shows an example diaphragm 102 with a dome 702. FIG. 7B shows a cross sectional view of the diaphragm 102 along the line A-A'. Now, referring to FIGS. 7A and 7B, the dome 702 is substantially disposed about the center of the diaphragm 102. In one example, the dome 702 may be thermoformed out of the central portion of the diaphragm 102. In one example, a central hole may be cut in the diaphragm 102 and a dome 702 may be glued to the center of the diaphragm 102, so as to cover the central hole. The dome 702 may be made of a different material than the diaphragm 102. For example, the dome 702 may be made of a material that provides high stiffness to weight ratio. Alloys of materials like Aluminum, Beryllium and Titanium may be considered for fabricating the dome 702.

When an audio signal is reproduced by the diaphragm, the intensity of the reproduced sound decreases, when the diaphragm enters its first and higher mode of vibration. The first and higher mode of vibration cancel the sound radiating from the diaphragm, thereby reducing the intensity of the reproduced sound. It is preferable to keep the first mode of vibration at a higher frequency. For example, at a frequency above 10 KHz. This results in a loudspeaker that is substantially efficient up to the first mode of vibration. Incorporating a stiff region about of the center portion of the diaphragm increases the frequency of the first mode of vibration. The dome structure described above in one example, increases the frequency of the first mode of vibration.

The first vibration mode frequency or fundamental shell Eigenfrequency (f1) of a shallow dome is proportional to the square root of the ratio of Young's Modulus E to the gravimetric density (ρ). Eigenfrequency (f1) is equal to square root of (E/ρ) divided by 2πR where R is the radius of curvature of the shallow dome. Radius of curvature R is given by the equation R is equal to (radius of the dome)× (radius of the dome) divided by 2 times the height of the dome. Table 8 shows Eigenfrequency (f1) for various materials for a dome with 15 mm radius and 3 mm height, giving a radius of curvature R of 37.5 mm.

Table 8 below shows that materials like Carbon Fiber panel, Aluminum, Titanium and Beryllium exhibit a higher Engenfrequency (f1) for a radius of curvature R of 37.5 mm, for example, an Eigenfrequency (f1) greater than 20 KHz.

TABLE 8

| Material | Modulus E/ GPa | Density ρ/ $10^3$ Kg $m^{-3}$ | Sqrt (E/ρ) | R/mm | f1 = Sqrt(E/ρ)/ 2πR/KHz |
|---|---|---|---|---|---|
| Polyimide (Kapton) | 2.5 | 1.42 | 1.33E+03 | 37.5 | 5.63 |
| Polyimide (UpilexS) | 9.1 | 1.47 | 2.49E+03 | 37.5 | 10.56 |
| PET | 2.8 | 1.39 | 1.42E+03 | 37.5 | 6.02 |
| Polycarbonate (Lexan) | 2.35 | 1.2 | 1.40E+03 | 37.5 | 5.94 |
| Carbon Fiber panel (T800) | 73.8 | 1.21 | 7.81E+03 | 37.5 | 33.15 |
| Aluminum | 70 | 2.68 | 5.11E+03 | 37.5 | 21.69 |
| Titanium | 116 | 4.51 | 5.07E+03 | 37.5 | 21.52 |
| Beryllium | 303 | 1.84 | 1.28E+04 | 37.5 | 54.46 |

In some examples, the diaphragm may be referred to as a sandwich panel diaphragm, where the diaphragm may have a plurality of layers of materials, to provide a desirable substrate for the diaphragm. In some examples, one or more layers of the substrate for the diaphragm may include a metal surface and the metal surface may be selectively etched or removed to form the coil over the diaphragm.

While embodiments of the present invention are described above with respect to what is currently considered its preferred embodiments, it is to be understood that the invention is not limited to that described above. To the contrary, the invention is intended to cover various modifications and equivalent arrangements within the spirit and scope of the appended claims.

What is claimed is:

1. A loudspeaker, comprising:

a diaphragm wherein the diaphragm has a fixed portion and a movable portion and wherein the fixed portion is attached to the movable portion by a plurality of leaf springs disposed between the fixed portion and the movable portion of the diaphragm;

a coil disposed over the diaphragm in the movable portion; and a magnet assembly operatively disposed relative to the coil, wherein upon flow of current through the coil, the movable portion of the diaphragm moves relative to the fixed portion, wherein the leaf spring has a first end portion, a second end portion and a body portion, the first end portion connected to the movable portion about an outer periphery of the movable portion and the second end portion connected to the fixed portion about an inner periphery of the fixed portion;

wherein a gap between the body portion of the leaf spring and the fixed portion define a portion of a first slot and a gap between the body portion of the leaf spring and the movable portion define a portion of a second slot, wherein, the first slot extends to an adjacent leaf spring to define a gap between the body portion of the adjacent leaf spring and the movable portion, and wherein, the second slot extends to another adjacent leaf spring to define a gap between the body portion of the another adjacent leaf spring and the fixed portion, and wherein the first slot and the second slot is filled with a material to substantially maintain a pressure differential between a top portion of the diaphragm and the bottom portion of the diaphragm created by the movement of the movable portion of the diaphragm; and wherein the magnet assembly includes a top magnet assembly and a bottom magnet assembly and the diaphragm disposed between the top magnet assembly and the bottom magnet assembly.

2. The loudspeaker of claim 1, wherein the magnet assembly creates a magnetic field substantially in the plane of the diaphragm and perpendicular to the flow of current through the coil.

3. The loudspeaker of claim 1, wherein the magnet assembly creates the magnetic field in a plurality of directions and the coil includes a plurality of sub coils, with each sub coil subjected to one of the plurality of directions of magnetic field, wherein a flow of current through each of the sub coils is arranged so as to move the movable part in the same direction.

4. The loudspeaker of claim 1, wherein a plurality of through holes are disposed in the top magnet assembly and the bottom magnet assembly to permit sound produced due to the vibration of the diaphragm to pass through the top magnet assembly and the bottom magnet assembly.

5. The loudspeaker of claim 1, wherein a bottom receiver cover is disposed over the bottom magnet assembly and a tweeter is disposed in the bottom receiver cover.

6. The loudspeaker of claim 1, wherein the material is a viscous material.

7. The loudspeaker of claim 1, wherein a stiffener is selectively disposed on the movable portion so as to maintain a substantially constant mechanical impedance for the movable portion.

8. The loudspeaker of claim 1, wherein a conductor of the coil begins and terminates on the fixed portion and a portion of the conductor of the coil enters and exits the movable portion over the body portion of one of the leaf spring.

9. The loudspeaker of claim 8, wherein a plurality of dummy conductors are disposed in the body portion of the other leaf springs so as to maintain a substantially similar compliance between the one of the leaf spring and other leaf springs.

10. The loudspeaker of claim 3, wherein, a winding length of each of the sub coil is selectively chosen based on the magnetic field strength imparted to each of the sub coil, to generate a substantially uniform force across the plurality of sub coils.

11. The loudspeaker of claim 1, wherein the diaphragm is a planar diaphragm.

12. The loudspeaker of claim 1, wherein the diaphragm is a panel form diaphragm.

13. The loudspeaker of claim 1, wherein the diaphragm is a conical diaphragm.

14. The loudspeaker of claim 1, wherein a central portion of the diaphragm is dome shaped.

15. A loudspeaker, comprising:

a diaphragm wherein the diaphragm has a fixed portion and a movable portion and wherein the fixed portion is attached to the movable portion by a plurality of leaf springs disposed between the fixed portion and the movable portion of the diaphragm;

a coil disposed over the diaphragm in the movable portion; and a magnet assembly operatively disposed relative to the coil, wherein upon flow of current through the coil, the movable portion of the diaphragm moves relative to the fixed portion, wherein the coil is selectively etched on a metal clad flexible printed circuit, a portion of a substrate of the flexible printed circuit selectively cut to form the plurality of leaf springs and the substrate of the flexible printed circuit, the coil and the plurality of leaf springs together form a combination of the diaphragm, coil and the plurality of leaf springs.

16. The loudspeaker of claim 15, wherein the leaf spring has a first end portion, a second end portion and a body portion, the first end portion connected to the movable portion about an outer periphery of the movable portion and the second end portion connected to the fixed portion about an inner periphery of the fixed portion;

wherein a gap between the body portion of the leaf spring and the fixed portion define a portion of a first slot and a gap between the body portion of the leaf spring and the movable portion define a portion of a second slot, wherein, the first slot extends to an adjacent leaf spring to define a gap between the body portion of the adjacent leaf spring and the movable portion; and wherein, the second slot extends to another adjacent leaf spring to define a gap between the body portion of the another adjacent leaf spring and the fixed portion, and wherein the first slot and the second slot is filled with a material to substantially maintain a pressure differential between a top portion of the diaphragm and the bottom portion of the diaphragm created by the movement of the movable portion of the diaphragm.

17. The loudspeaker of claim 15, wherein the magnet assembly creates a magnetic field substantially in the plane of the diaphragm and perpendicular to the flow of current through the coil.

18. The loudspeaker of claim 15, wherein the magnet assembly creates the magnetic field in a plurality of directions and the coil includes a plurality of sub coils, with each sub coil subjected to one of the plurality of directions of magnetic field, wherein a flow of current through each of the sub coils is arranged so as to move the movable part in the same direction.

19. The loudspeaker of claim 15, wherein the magnet assembly includes a top magnet assembly and a bottom magnet assembly and the diaphragm disposed between the top magnet assembly and the bottom magnet assembly; and wherein a plurality of through holes are disposed in the top magnet assembly and the bottom magnet assembly to permit sound produced due to the vibration of the diaphragm to pass through the top magnet assembly and the bottom magnet assembly.

20. The loudspeaker of claim 15, wherein a bottom receiver cover is disposed over the bottom magnet assembly and a tweeter is disposed in the bottom receiver cover.

21. The loudspeaker of claim 15, wherein the leaf spring has a first end portion, a second end portion and a body portion, the first end portion connected to the movable portion about an outer periphery of the movable portion and the second end portion connected to the fixed portion about an inner periphery of the fixed portion; and wherein a conductor of the coil begins and terminates on the fixed portion and a portion of the conductor of the coil enters and exits the movable portion over the body portion of one of the leaf spring.

22. The loudspeaker of claim 21, wherein a plurality of dummy conductors are disposed in the body portion of the other leaf springs so as to maintain a substantially similar compliance between the one of the leaf spring and other leaf springs.

23. A loudspeaker, comprising:

a diaphragm wherein the diaphragm has a fixed portion and a movable portion and wherein the fixed portion is attached to the movable portion by a plurality of leaf springs disposed between the fixed portion and the movable portion of the diaphragm;

a coil disposed over the diaphragm in the movable portion; and a magnet assembly operatively disposed relative to the coil, wherein upon flow of current through the coil, the movable portion of the diaphragm moves relative to the fixed portion, wherein the coil is selectively printed on a substrate, a portion of the substrate selectively cut to form the plurality of leaf springs and the substrate, the coil and the plurality of leaf springs together form a combination of the diaphragm, the coil and the plurality of leaf springs.

24. The loudspeaker of claim 23, wherein the leaf spring has a first end portion, a second end portion and a body portion, the first end portion connected to the movable portion about an outer periphery of the movable portion and the second end portion connected to the fixed portion about an inner periphery of the fixed portion;

wherein a gap between the body portion of the leaf spring and the fixed portion define a portion of a first slot and a gap between the body portion of the leaf spring and the movable portion define a portion of a second slot, wherein, the first slot extends to an adjacent leaf spring to define a gap between the body portion of the adjacent leaf spring and the movable portion; and wherein, the second slot extends to another adjacent leaf spring to define a gap between the body portion of the another adjacent leaf spring and the fixed portion, and wherein the first slot and the second slot is filled with a material to substantially maintain a pressure differential between a top portion of the diaphragm and the bottom portion of the diaphragm created by the movement of the movable portion of the diaphragm.

25. The loudspeaker of claim 23, wherein the magnet assembly creates a magnetic field substantially in the plane of the diaphragm and perpendicular to the flow of current through the coil.

26. The loudspeaker of claim 23, wherein the magnet assembly creates the magnetic field in a plurality of directions and the coil includes a plurality of sub coils, with each sub coil subjected to one of the plurality of directions of magnetic field, wherein a flow of current through each of the sub coils is arranged so as to move the movable part in the same direction.

27. The loudspeaker of claim 23, wherein the magnet assembly includes a top magnet assembly and a bottom magnet assembly and the diaphragm disposed between the top magnet assembly and the bottom magnet assembly; and wherein a plurality of through holes are disposed in the top magnet assembly and the bottom magnet assembly to permit sound produced due to the vibration of the diaphragm to pass through the top magnet assembly and the bottom magnet assembly.

28. The loudspeaker of claim 23, wherein a bottom receiver cover is disposed over the bottom magnet assembly and a tweeter is disposed in the bottom receiver cover.

29. The loudspeaker of claim 23, wherein the leaf spring has a first end portion, a second end portion and a body portion, the first end portion connected to the movable portion about an outer periphery of the movable portion and the second end portion connected to the fixed portion about an inner periphery of the fixed portion; and wherein a conductor of the coil begins and terminates on the fixed portion and a portion of the conductor of the coil enters and exits the movable portion over the body portion of one of the leaf spring.

30. The loudspeaker of claim 29, wherein a plurality of dummy conductors are disposed in the body portion of the other leaf springs so as to maintain a substantially similar compliance between the one of the leaf spring and other leaf springs.

31. A loudspeaker, comprising:

a diaphragm wherein the diaphragm has a fixed portion and a movable portion and wherein the fixed portion is attached to the movable portion by a plurality of leaf springs disposed between the fixed portion and the movable portion of the diaphragm;

a coil disposed over the diaphragm in the movable portion; and a magnet assembly operatively disposed relative to the coil, wherein upon flow of current through the coil, the movable portion of the diaphragm moves relative to the fixed portion, wherein the coil is selectively deposited on a substrate, a portion of the substrate selectively cut to form the plurality of leaf springs and the substrate, the coil and the plurality of leaf springs together form a combination of the diaphragm, the coil and the plurality of leaf springs.

32. The loudspeaker of claim 31, wherein the leaf spring has a first end portion, a second end portion and a body portion, the first end portion connected to the movable portion about an outer periphery of the movable portion and the second end portion connected to the fixed portion about an inner periphery of the fixed portion;

wherein a gap between the body portion of the leaf spring and the fixed portion define a portion of a first slot and a gap between the body portion of the leaf spring and the movable portion define a portion of a second slot, wherein, the first slot extends to an adjacent leaf spring to define a gap between the body portion of the adjacent leaf spring and the movable portion; and wherein, the second slot extends to another adjacent leaf spring to define a gap between the body portion of the another adjacent leaf spring and the fixed portion, and wherein the first slot and the second slot is filled with a material to substantially maintain a pressure differential between a top portion of the diaphragm and the bottom portion of the diaphragm created by the movement of the movable portion of the diaphragm.

33. The loudspeaker of claim 31, wherein the magnet assembly creates a magnetic field substantially in the plane of the diaphragm and perpendicular to the flow of current through the coil.

34. The loudspeaker of claim 31, wherein the magnet assembly creates the magnetic field in a plurality of directions and the coil includes a plurality of sub coils, with each sub coil subjected to one of the plurality of directions of magnetic field, wherein a flow of current through each of the sub coils is arranged so as to move the movable part in the same direction.

35. The loudspeaker of claim 31, wherein the magnet assembly includes a top magnet assembly and a bottom magnet assembly and the diaphragm disposed between the top magnet assembly and the bottom magnet assembly; and wherein a plurality of through holes are disposed in the top magnet assembly and the bottom magnet assembly to permit sound produced due to the vibration of the diaphragm to pass through the top magnet assembly and the bottom magnet assembly.

36. The loudspeaker of claim 31, wherein a bottom receiver cover is disposed over the bottom magnet assembly and a tweeter is disposed in the bottom receiver cover.

37. The loudspeaker of claim 31, wherein the leaf spring has a first end portion, a second end portion and a body portion, the first end portion connected to the movable portion about an outer periphery of the movable portion and the second end portion connected to the fixed portion about an inner periphery of the fixed portion; and wherein a conductor of the coil begins and terminates on the fixed portion and a portion of the conductor of the coil enters and exits the movable portion over the body portion of one of the leaf spring.

38. The loudspeaker of claim 37, wherein a plurality of dummy conductors are disposed in the body portion of the other leaf springs so as to maintain a substantially similar compliance between the one of the leaf spring and other leaf springs.

* * * * *